United States Patent [19]

Driscoll et al.

[11] 3,972,243

[45] Aug. 3, 1976

[54] TRACTION DRIVE WITH A TRACTION FLUID CONTAINING GEM-STRUCTURED POLAR ORGANO COMPOUND

[75] Inventors: Gary L. Driscoll, Boothwyn; Marcus W. Haseltine, Jr., Brookhaven, both of Pa.

[73] Assignee: Sun Research and Development Co., Marcus Hook, Pa.

[22] Filed: July 23, 1973

[21] Appl. No.: 381,634

Related U.S. Application Data

[63] Continuation-in-part of Ser. Nos. 135,295, April 19, 1971, Ser. No. 144,165, May 17, 1971, Pat. No. 3,715,313, and Ser. No. 152,303, June 11, 1971, Pat. No. 3,793,203.

[52] U.S. Cl. ..... 74/200; 252/32; 252/45; 252/48.2; 252/49.8; 252/50; 252/51.5 H; 252/52 R; 252/56 R; 252/58; 260/348 A; 260/429.2; 260/455 R; 260/456 R; 260/457; 260/478; 260/526 R; 260/544 R; 260/561 R; 260/561 H; 260/566 F; 260/583 R; 260/593 R; 260/609 R; 260/614 R; 260/632 R; 260/652 R; 260/963; 260/967

[51] Int. Cl. ..... F16h 15/08

[58] Field of Search ..... 252/50, 51.5 A; 74/200

[56] References Cited

UNITED STATES PATENTS

| | | | |
|---|---|---|---|
| 2,832,741 | 4/1958 | Gottshall et al. | 252/50 |
| 3,000,824 | 9/1961 | Morway et al. | 252/50 X |
| 3,211,647 | 10/1965 | O'Halloran et al. | 252/50 X |
| 3,219,666 | 11/1965 | Norman et al. | 252/51.5 A |
| 3,224,957 | 12/1965 | Kent | 252/51.5 A X |
| 3,235,495 | 2/1966 | Buehler | 252/51.5 A X |
| 3,394,603 | 7/1968 | Rounds | 74/200 |
| 3,411,369 | 11/1968 | Hammann et al. | 74/200 |
| 3,440,894 | 4/1969 | Hammann et al. | 74/200 |
| 3,449,249 | 6/1969 | Anderson | 252/51.5 A |
| 3,608,385 | 9/1971 | Duling et al. | 74/200 |
| R27,211 | 11/1971 | Rounds | 74/200 |

OTHER PUBLICATIONS

Rounds, J. Chem. and Eng. data, vol. 5, No. 4, pp. 499 to 507, (1960).

*Primary Examiner*—Helen M. S. Sneed
*Attorney, Agent, or Firm*—Donald R. Johnson; J. Edward Hess; Richard P. Maloney

[57] ABSTRACT

Polyolefins, paraffins and polar compounds containing a gem-structured hydrocarbon "backbone" are useful as traction fluids or as components of traction fluids. For example, compositions, useful as additives to lubricants (e.g., components of traction fluids), are produced by ozonolysis of polyolefins, particularly of polyisobutylene oligomers containing at least one pair of maximally crowded geminal methyl groups to produce gem-structured, oxygenated derivatives (ketones, esters, acids, aldehydes, alcohols, etc.). Other polar compounds, useful as additives to lubricants or other mineral oil products (e.g., rubber process oils) can be obtained by conversion of polyisobutylene oligomers to polar compounds containing such functional groups as amine, imine, thioketone, amide, thioester, phosphate esters of the alcohols, ether, oxime, acyl halide, acyl hydrazide, chloride, bromide and maleic anhydride adducts. Salts of the carboxylic acids can also be useful as lubricant additives. A tin complex can also be made which has antiwear properties. Compositions comprising 0.1 to 100 weight percent of the gem-structured polar compounds and a base oil (e.g., a paraffinic lube, naphthenic lube, a hydrogenated naphthenic or paraffinic lube, polyolefins or hydrogenated polyolefins, synthetic esters and mixtures of such oils) are especially useful as lubricants.

16 Claims, 1 Drawing Figure

| | |
|---|---|
| $KV_{210}$ | 3.86 |
| $KV_{100}$ | 18.1 |
| VTF-VI | 111 |
| ASTM-VI | 116 |

TRACTION DRIVE WITH A TRACTION FLUID CONTAINING GEM-STRUCTURED POLAR ORGANO COMPOUND

CROSS REFERENCES TO RELATED APPLICATIONS

This application is a continuation-in-part of Ser. No. 135,295 filed Apr. 19, 1971, Ser. No. 144,165 filed May 17, 1971 (now U.S. 3,715,313 issued Feb. 6, 1973), and Serial No. 152,303 filed June 11, 1971 (now U.S. Pat. No. 3,793,203 issued Feb. 19, 1974), the entire disclosure of said applications being incorporated herein by reference.

Also incorporated herein by reference is the entire disclosure of U.S. Pat. No. 3,411,369 issued Nov. 19, 1968, U.S. Pat. No. 3,440,894 issued Apr. 29, 1969, U.S. Pat. No. 3,597,358 issued Aug. 3, 1971, U.S. Pat. No. 3,595,796 issued July 27, 1971, U.S. Pat. No. 3,595,797 issued July 27, 1971, U.S. Pat. No. 3,598,740 issued Aug. 10, 1971, U.S. Pat. No. 3,608,385 issued Sept. 28, 1971 and U.S. Pat. No. 3,648,531 issued Mar. 14, 1972, all of which disclose tractive or friction drives in which the present polar compounds can be used as lubricants per se or as base oils and tractive fluids (or base oils) in which the present polar compounds can be used as additives. Also incorporated herein is the entire disclosure of U.S. Pat. No. 3,619,414 issued Nov. 9, 1971, U.S. Pat. No. 3,646,224 issued Feb. 29, 1972, U.S. Pat. No. 3,560,578 issued Feb. 2, 1971 and U.S. Pat. No. 3,676,521 issued July 11, 1972, all of which disclose base oils or components of base oils in which the present polar compounds can be useful as additives.

In commonly-owned copending application Ser. No. 52,301 filed July 6, 1970 of Gary L. Driscoll, Irl N. Duling and David S. Gates (now U.S. Pat. 3,778,487 issued December 11, 1973), novel polyolefin and hydrogenated polyolefin oils are described which are useful as traction fluids, or as components of traction fluids. In particular, said application discloses oils consisting essentially of isobutene oligomers in the $C_{12}$–$C_{48}$ carbon number range. The novel polyolefin oils or the individual olefins therein are also disclosed as being useful as chemical intermediates to prepare novel polar components (such as alcohols, acids, esters, ketones, thioketones, amides, amines, thioesters, phosphate esters of the alcohols and thioesters). The ketones, and other non-acidic ozonolysis products are disclosed as being useful as traction fluids or as components of traction fluids. Said application also contains a declaration that such derivatives, and their use as traction fluids or as antiwear additives in lubricants are the invention of Gary L. Driscoll and Marcus W. Haseltine, Jr., the present applicants.

Other relevant applications are listed in the following table:

| Serial No. | Filing Date | Title/Inventor(s) |
|---|---|---|
| 028,942 | 4-15-70 | Process for Producing Polyisobutylene Oil - ALFRED E. HIRSCHLER and GARY L. DRISCOLL |
| 033,023 | 4-29-70 | Combination of Tractive Drive and Traction Fluid Comprising Cyclic or Acyclic Compounds - IRL N. DULING and FREDERICK P. GLAZIER |
| 052,300 (now U.S. Pat. No. 3,775,503 issued November 27, 1973) | 7-6-70 | Branched Hydrocarbons in the $C_{16}$–$C_{40}$ Range Having Maximally Crowded Geminal Methyl Groups - GARY L. DRISCOLL - IRL. N. DULING - DAVID S. GATES and ROBERT W. WARREN |
| 052,301 (now U.S. Pat. No. 3,778,487 issued December 11, 1973) | 7-6-70 | Polyisobutylene Oil Having a High Viscosity Index - GARY L. DRISCOLL - IRL N. DULING and DAVID S. GATES |
| 052,771 (Abandoned) | 7-6-70 | Polymerization of Dialkyl Vinylidene Compounds to Oils - GARY L. DRISCOLL |
| 052,772 (now U.S. Pat. No. 3,655,808 issued April 11, 1972) | 7-6-70 | Preparation of Oils from Isobutene GARY L. DRISCOLL |
| 052,773 (now U.S. Pat. No. 3,657,369 issued April 10, 1972) | 7-6-70 | Oligomerization of Isobutene annd α-Methylstyrene - GARY L. DRISCOLL and DAVID L. KERR |
| 053,268 (Abandoned) | 7-6-70 | Phosphorous Compounds Promoted Oligomerization of Isobutene - GARY L. DRISCOLL |
| 056,680 | 7-20-70 | Reaction of Alkyladamantane Compounds to Form Products Having Two Linked Nuclei - ROBERT F. MOORE and ABRAHAM SCHNEIDER |
| 080,779 (now U.S. Pat. No. 3,646,233 issued February 29, 1972) | 10-14-70 | Reaction of Normal Paraffins with Adamantane Compounds - ROBERT E. MOORE |
| 091,183 (now U.S. Pat. No. 3,646,234 issued February 29, 1972) | 11-19-70 | Reaction of Naphthene Hydrocarbons With Adamantane Compounds - ROBERT E. MOORE |
| 133,637 | 4-13-71 | Combination of Tractive Drive and Traction Fluid Comprising Saturated Cyclic Compounds - IRL N. DULING and FREDERICK P. GLAZIER |
| 134,095 (now abandoned) | 4-14-71 | Polymerization of Dialkyl Vinylidene Compounds to Oils - GARY L. DRISCOLL |
| 135,295 | 4-19-71 | Chemical Reaction Products of Polyisobutylene - GARY L. DRISCOLL and MARCUS W. HASELTINE, JR. |
| 137,556 | 4-26-71 | Chemical Reacton Product of Sulfur, Lard Oil and Polyisobutylene - ALEXANDER D. RECCHUITE and GARY L. DRISCOLL |

-continued

| Serial No. | Filing Date | Title/Inventor(s) |
|---|---|---|
| 155,986 (now U.S. Pat. No. 3,843,537 issued October 22, 1974) | 6-23-71 | Blended Traction Fluid Containing Cyclic Compounds - IRL N. DULING and DAVID S. GATES |
| 165,141 (now U.S. Pat. No. 3,759,817 issued September 18, 1973) | 7-22-71 | Blend Comprising Hydrorefined Oil and Unhydrorefined Oil - IVOR W. MILLS and GLENN R. DIMELER |
| 178,479 (now U.S. Pat. No. 3,816,316 issued June 11, 1974) | 9-7-71 | Soap Thickened Hydraulic Oil Composition - JOHN Q. GRIFFITH, III - EDWARD S. WILLIAMS and WILLIAM H. REILAND, JR. |
| 218,338 | 1-17-72 | Process for Preparation of Isomers of 1-cyclohexyl-1,3,3-trimethylhydrindane - PETER HOSLER and DAVID S. GATES |
| 218,394 | 1-17-72 | Lubricant for a Controlled Slip Differential - MARCUS W. HASELTINE, JR. - DAVID S. GATES and PAUL E. HAGSTROM |
| 228,832 (now U.S. Pat. No. 3,839,189 issued October 1, 1974) | 2-24-72 | Hydrorefined Lube Oil and Process of Manufacture - IVOR W. MILLS and GLENN R. DIMELER |
| 244,274 (now U.S. Pat. No. 3,816,346 issued June 11, 1974) | 4-14-72 | Lubricant for Spindles, Needles or Twister Rings - WALTER J. COPPOCK - JAMES R. AMAROSO and JOHN Q. GRIFFITH, III |
| 246,737 (now U.S. Pat. No. 3,764,516 issued October 9, 1973) | 4-24-72 | Isomerization of Waxy Lube Streams and Waxes Using Zeolite Catalyst - IB STEINMETZ and DAVID S. BARNBY |
| 246,997 | 4-24-72 | Rust Lubrication With Oil Containing A Polymeric Additive - THOMAS D. NEWINGHAM-JAMES R. AMAROSO-WALTER J. COPPOCK and EDWARD S. WILLIAMS |
| 269,625 | 7-7-72 | Ethylene-Propylene Copolymer Oil and Process of Manufacture - RICHARD S. STEARNS-IRL N. DULING and DAVID S. GATES |
| 279,160 | 8-9-72 | Lubricant Comprising Petroleum Oil and Azelate Diester - THOMAS D. NEWINGHAM and RALPH J. DEBERARDINIS |
| 280,919 | 8-15-72 | Process Comprising Solvent Extraction of a Blended Oil - IVOR W. MILLS |
| 298,126 | 10-16-72 | Composition Comprising Naphthenic Distillate Hydrocracked Lube and an Antioxidant - ROBERT P. BRYER-THOMAS D. NEWINGHAM-IVOR W. MILLS and GLENN R. DIMELER |
| 320,357 | 1-2-73 | Apparatus for Testing Coefficient of Traction and Method of Use Thereof - RICHARD J. STENGER |

The disclosure of all of the above-cited applications is hereby incorporated herein by this reference. In particular, these applications disclose base oils including blended lubricants in which the polar compounds of the present invention can be useful as additives, other additives which can be useful in such lubricants, processes for making individual components of such lubricants, and many uses for such lubricants containing the polar compounds of the present invention, including refrigerator oils, mist lubricants, hydraulic oils and gear lubricants. The apparatus and method of Ser. No. 320,357 is especially useful in testing (as to determine the suitability of a given polar compound as a traction fluid or as a component thereof).

SUMMARY OF THE INVENTION

Certain of the novel polyolefin oils of Serial No. 52,301 consist essentially of "true isobutylene oligomers". Such oligomers are gem-structured, have crowded geminal methyl groups and are further described hereinafter. Substantially pure olefins of a single carbon number can be obtained as distillate fractions of such oils. The fractions or the oils are useful as lubricants (as for traction drives or for a controlled slip differential) and can be converted, by hydrogenation or other well known reactions, into gem-structured paraffins or polar compounds, which are useful as lubricants or components of blended lubricants.

Such reactions are disclosed, fo example, in the aforementioned applications Ser. No. 52,300; Ser. No. 52,301, Ser. No. 135,295; Ser. No. 137,556; Ser. No. 144,165 and Ser. No. 152,303.

More generally, novel polyolefin oils of monomers of the formula:

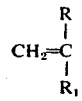

wherein R is $-CH_3$ and $-C_2H_5$ and $R_1$ is an alkyl group of from 1 to 10 carbon atoms, have exceptionally high viscosity indices and high coefficients of traction and consist essentially of unisomerized, true oligomers, such as true polyisobutylene oligomers (e.g., $C_{16}H_{32}$, $C_{20}H_{40}$, $C_{24}H_{48}$ . . . $C_{48}H_{96}$). The novel oils are useful as electrical oils, as chemical intermediates or as tractants (i.e. as traction fluids or as components of traction fluids). The hydrogenated oils are novel and especially useful as tractants, particularly when hydrogenated to a bromine number less than 10 (more preferably, less than 5). The unique character of these novel oils, whether olefin and/or paraffin, can be proved by a combination of gas chromatography and nuclear magnetic reasonance spectroscopy (NMR). These olefins, and the paraffins produced by hydrogenation thereof, are characterized by "crowded" and sterically hindered geminal methyl and isolated methylene groups. The individual species in the range of $C_{16}$ to $C_{48}$ can be separated from the whole oil by vapor phase chromatography. One such novel polyolefin oil having an ASTM viscosity index greater than 85, consists essentially of monoolefins of carbon numbers $C_{24}$, $C_{28}$, $C_{32}$, $C_{36}$ and $C_{40}$ and having repeating isobutylene structures.

In general, improved traction fluids and components of traction fluids can be obtained by putting a polar group on a gem-structured hydrocarbon (such as the gem-structured polyisobutylenes), preferably, the compound contains no aromatic or olefinic unsaturation. The resulting polar molecule appears to be more strongly attracted to metal surfaces (compared to the parent hydrocarbon) and thus produces higher traction. That such traction fluids exhibit high traction is unexpected since the literature (see Rounds, J. Chem. & Eng. Vol. 5 (No. 4) Oct., 1960, and included references) teaches that hydrocarbons containing polar groups on one end reduce the static and dynamic friction of mineral oils.

For example, compounds which are useful as traction fluids or as components of traction fluids or other lubricants can be represented by the following structural formula:

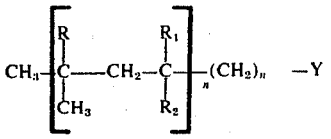

wherein $n$ is an integer from 1–30, $n'$ is 0 or 1, R, $R_1$ and $R_2$ are one or a combination of the following radicals: methyl, ethyl, propyl, isopropyl, butyl, isobutyl, tert-butyl, isopentyl, neopentyl, cyclohexyl, methylcyclohexyl, indanyl, hydrindanyl, cyclohexylindanyl, cyclohexyl hydrindanyl; and where Y would be any of the following functional groups: ketone, carboxylic acid, acid salts, ether, alcohol, ester, acyl halide, acyl hydrazide, mercaptan, epoxy, thioester, thiolester, thioether, phosphate (including coesters), phosphite (including coesters), sulfate, sulfite, sulfonate, halide, oxime, imine, amide, amine or maleic anhydride adduct. More than one functional group can be pesent in a given molecule (e.g. imine and amine). Also, the indanyl compounds and/or their cyclohexyl moieties, may be $C_{1-6}$ lower alkyl-substituted, as for example, with a methyl group. Tin complexes, as hereinafter described, are also polar compounds within the scope of this invention.

In the above described polar compounds, the following structural formulae represent the various indicated functional groups:

Ketone includes

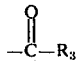

Carboxylic acid includes

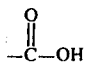

Alcohol includes —OH and

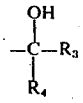

Ester includes

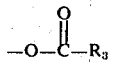

and

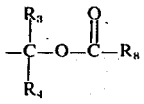

Acyl halide includes

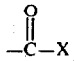

Thioether includes —S—$R_3$

Epoxy includes

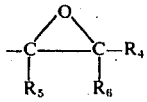

Thioester includes

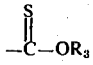

Thiolester includes

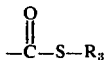

Phosphate (or the coester) includes

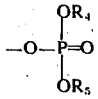

and

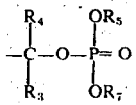

Phosphite (including the

-continued coester) includes

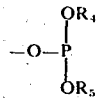

Other useful phosphorus containing radicals include

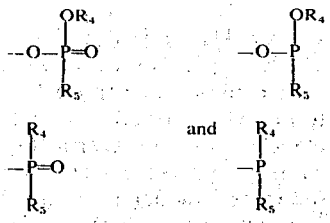

Sulfate includes

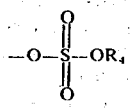

and

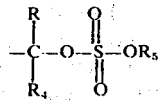

Halide includes

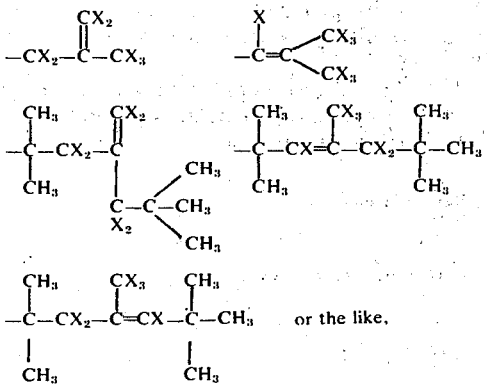

wherein X is chlorine, bromine or iodine and one or more of the hydrogens of the corresponding hydrocabon is replaced by halogen.

Amide includes

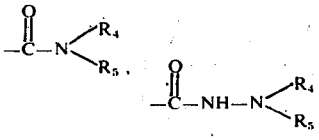

and

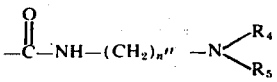

where N'' is an integer from 1 to 12,

Amine includes

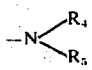

and any radical which can be obtained by reduction of the amide (as with hydrogen in the presence of Raney Nickel in a solvent, e.g. ethanol).

In the above structures, $R_3$ and $R_8$ can be an alkyl group having one to seven carbon atoms or a cyclic or alkyl-substituted cyclic hydrocarbon radical which can be saturated, olefinic or aromatic (and preferably saturated), and includes (but is not limited to) the radicals described hereinabove as R, $R_1$ and $R_2$. $R_4$, $R_5$ and $R_7$ are hydrogen or any of the radicals or groups described for $R_3$ and $R_8$. $R_6$ is methyl or hydrogen. $R_3$, $R_4$, $R_5$, $R_6$ and $R_7$, when on the same molecule, can be the same radical or different radicals.

A preferred class of polar compounds coming within the above-described structural formula is obtained from the "true" polyisobutylene oligimers, or the other vinylidene polymers, described more fully hereinafter, by such chemical reactions as those of the examples herein or by conventional organic reactions used to make polar derivatives of olefins. With the polyisobutylene oligimers, these polar compounds can be described by the formula

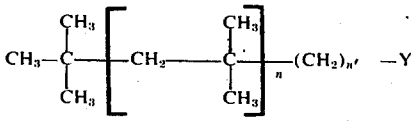

where *n*, n' and Y are as previously described.

Such polar compounds are particularly useful as tractants when added in major (e.g. 50–90 volume percent) quantities or minimum effective amounts (e.g. 1 percent, more preferably 3 percent, and typically at least 6 percent) to such as paraffinic lubes (preferably solvent refined and/or dewaxed), naphthenic lubes (preferably naphthenic acid free), polyolefin fluids and synthetic (e.g. see U.S. Pat. No. 3,287,259) naphthenic lubes. All of the above-referred to base oils can be partially or fully hydrogenated to improved chemical and/or thermal stability and to permit longer periods of high traction under use conditions. Particularly useful lubricants comprise such a hydrogenated base oil which contains less than 5 weight percent of gel aromatic compounds and less than 10 weight percent of olefins and which also contains from 0.520 percent of a gem-structured polar compound, preferably, corresponding to the above formula.

In one embodiment, the present invention involves lubricant compositions comprising chemical compounds which can be produced by the action of various chemical reagents on the polyolefins or polyolefin oils. Similar reactions can be performed on other gem-substituted olefins to obtain the polar component of the present invention. Such compounds are useful as lubricant additives, particularly lubricants for tractive drives, friction drives and limited slip differentials.

One typical toric traction transmission is that described in Hewko et al., "Tractive Capacity and Efficiency of Rolling Contacts," Proceedings of the Symposium on Rolling Contact Phenomena, Elsevier Amsterdam, 1962, pp. 159–161.

Circulation of the lubricant throughout the drive unit can be accomplished by spray lubrication or by splash effect. In a further embodiment, the lubricant is applied in mist or aerosol form. For mist lubrication, the lubricant can contain, to improve reclassification and/or reduce stray mist, an effective amount (e.g. 0.01–2 weight percent polymer) of a polymeric additive selected from one or a mixture of acrylic, methacrylic, olefin (e.g. isobutylene) and styrene (e.g. α-methylstyrene) polymers having a viscosity average molecular weight in the range of 10,000–2,000,000 (preferably 100,000 to 500,000). Such additives are described in the prior art. Of the above noted polar additives the more preferred are the polyolefins and the polar polyolefins (e.g. poly(methyl methacrylate)).

For example, one embodiment of the invention is a traction drive comprising at least two relatively rotatable members in torque transmitting relationship, the tractive surfaces of said members having disposed thereon a tractant composition containing at least one weight percent, preferably, at least 5 percent of an oxygen-containing chemical compound of a branched olefin hydrocarbon having 12 to 120 carbon atoms (more preferably 20 to 80), said olefin hydrocarbon having the formula:

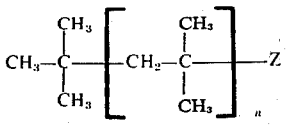

wherein n is an integer from 0 to 29 inclusive (more preferably 2–10), and wherein Z is:

(A)

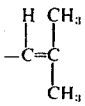

or (B)

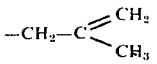

-continued or (C)

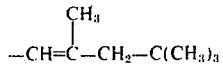

or (D)

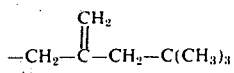

or (E)

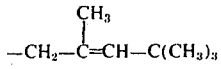

For example, such a compound is produced when said olefin is split at the double bond to produce two fragments, each said fragment having a carboxyl group at the site of the original attachment. Other compounds can be produced by further reaction of one of said fragments, said reaction involving either further fragmentation (e.g., decarboxylation), further oxidation, or both.

Ozonolysis of the olefin is one means of producing said compositions. Various novel compounds and compositions can be produced depending upon the nature of the olefin. For example, when Z is (A), such compounds can be produced by at least one of the following reactions:

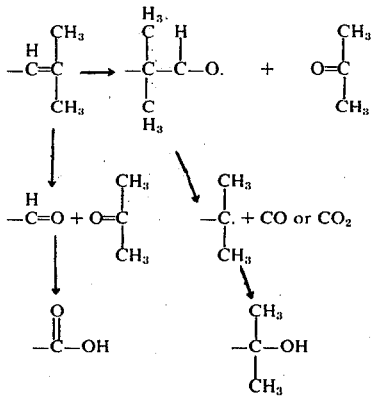

or when Z is (B), said compounds can be produced by the reaction:

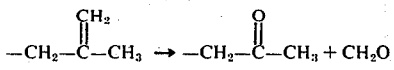

or when Z is (C) such compounds can be produced by at least one of the reactions:

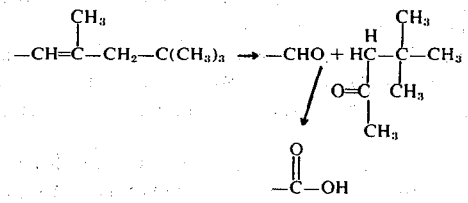

or when Z is (D) such compounds can be produced by the reaction:

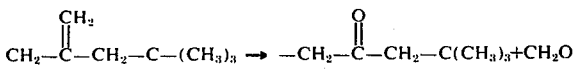

or when Z is (E) said compound is produced by at least one of the reactions:

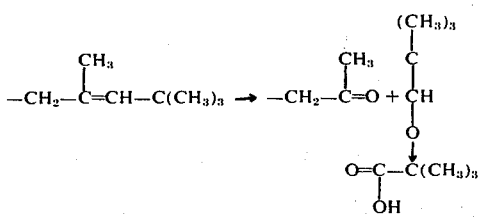

One class of preferred oxygen containing compounds in the present invention contain at least 11 carbon atoms (more preferred at least 15) and have the structural formula

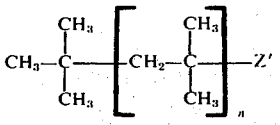

where $n$ is an integer from 0 to 29 inclusive and wherein Z′ is

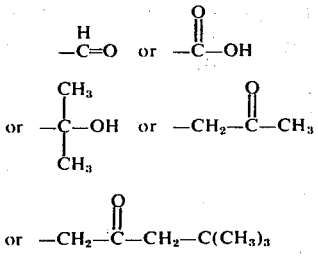

Typically, compositions can be obtained which contain 85–99 weight percent of one or a mixture of such oxygen-containing compounds having a polyisobutylene backbone.

Epoxides can be made from any of the above-described olefins by reaction of the olfin with 30–95 percent (e.g. 90 percent) hydrogen peroxide preferably in the presence of $MoO_3$ catalyst.

The substituted polybutene components of the present invention are usually liquids and have good solubility in petroleum oils. Therefore, these derivatives can be especially useful as lubricant additives or as additives to other oils, or petroleum products (such as rubber process oils, hydraulic fluids, fuels, refrigeration oils, textile machinery lubricants, coolant for a nuclear reactor, paints, etc.). By choice of the molecular weight (or viscosity) of the polyolefin starting material, the derivatives can be "tailored" to a desired viscosity or molecular weight.

An important requirement of a traction fluid for use in such an automotive transmission system is that it not only have good traction properties, but also be a good lubricant for the differential gear and differential ball, and a good lubricant for the rollers and races. Although such a traction fluid could also be used as the hydraulic fluid in the toric unit, if a hydraulic fluid of low traction (e.g. high VI) is used, it is preferred that the hydraulic fluid contain an indicator means, such as a distinctive dye, so that leakage of the hydraulic fluid into the main body of the drive unit can be detected by inspection of the main body of traction fluid, such as by a dip-stick arrangement.

To prevent loss of fluid by vaporization and to insure against introduction of contaminants into the fluid, the transmission system should be fully enclosed and well sealed. With the more volatile fluids, the seals and system should be capable of withstanding pressure exerted by the vaporized portion of the fluid at operating temperatures.

DESCRIPTION OF THE DRAWING

The accompanying drawing is typical of a vapor phase chromatogram, in the $C_{16}$–$C_{32}$ region, of a novel polyisobutene oil of the present invention, and, by nearly baseline resolution (the broken line is the base line), indicates the very minor content therein of cracked, isomerized or other non-isobutene oligimer species. The vapor phase chromatogram of the same oil after hydrogenation will also be similar to that of the figure with respect to the virtual base line resolution.

Each peak in the drawing is produced by a unique hydrocarbon species (e.g. $C_{20}$), characterized by maximally crowded and sterically hindered geminal methyl and isolated methylene groups.

Figure 1:
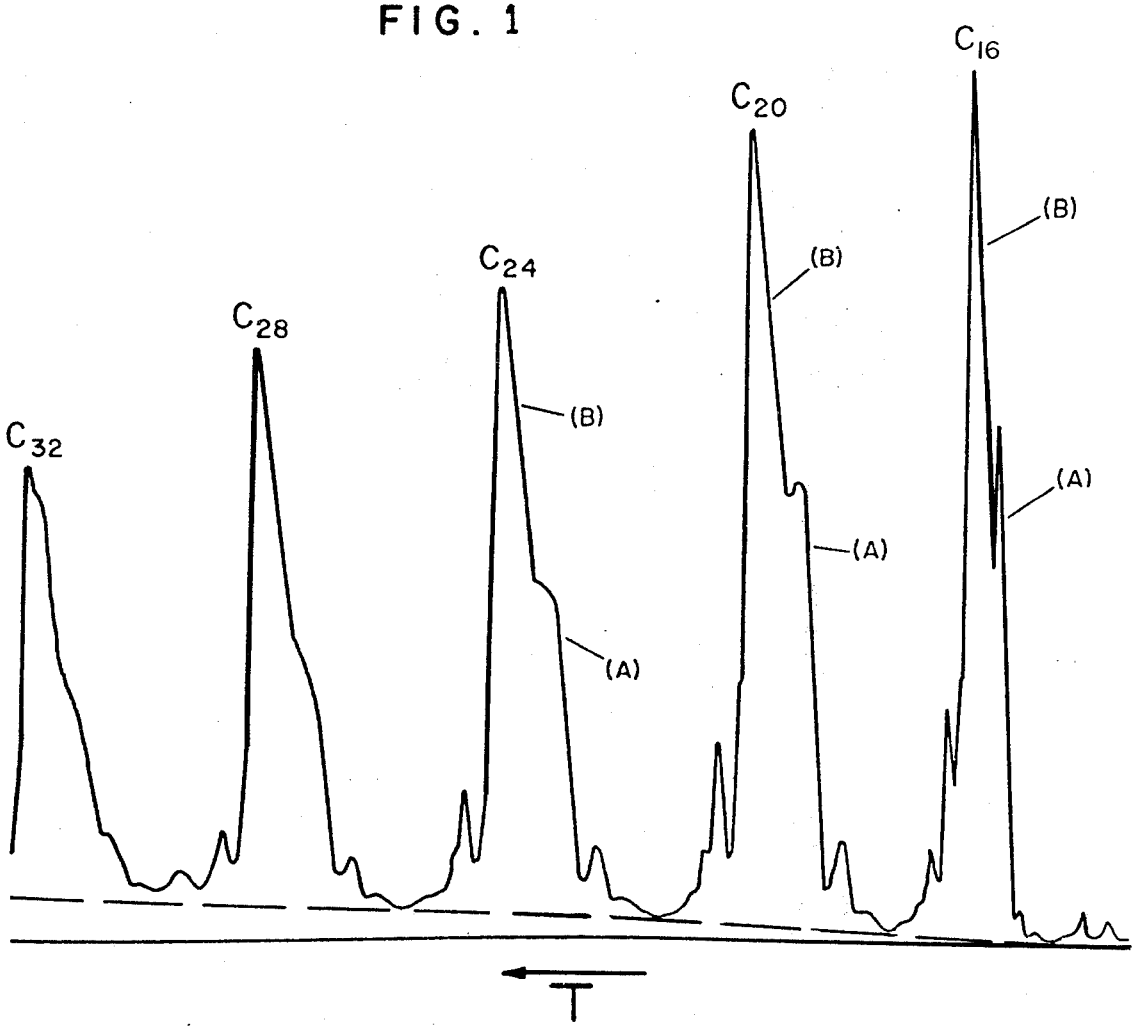

Vapor phase chromatograms of commercially available polybutene oils show that such oils do not consist essentially of true oligimers of isobutene but contain appreciable amounts of virtually all of the carbon number species which could be present within the carbon number range of the oil. For example, a commercially available polybutene oil produced distinct VPC peaks within the $C_{16}$–$C_{29}$ range which could be identified as $C_{16}$, $C_{17}$, $C_{19}$, $C_{20}$, $C_{23}$, etc. This oil also had far from base line resolution (i.e. an "envelope", thus, indicating the presence of many iosmeric forms of the other possible carbon number species (e.g. $C_{18}$, $C_{22}$, $C_{26}$).

The novel polyisobutylene and hydrogenated polyisobutylene oils of the present invention have a higher viscosity index (usually at least 10 percent higher) than oils of the same viscosity at 210°F prepared from polyisobutylene by prior art techniques. Although the present invention includes oils consisting essentially of isobutene oligimers in the $C_{12}$–$C_{48}$ carbon number range, the more preferred polyisobutene oils described herein, have a viscosity index in the range of 90–130 (typically at least 95) and consist essentially of true polyisobutene oligimers in the 20–40 carbon number range. As used herein viscosity index (unless specified as "ASTM") refers to Viscosity Temperature Function Viscosity Index (VTF-VI) as determined by the technique of W. A. Wright as set forth in ASTM Bulletin No. 215, 84, (1956). This value is similar to that obtained by ASTM D 2270 which is reported herein as ASTM-VI.

FURTHER DESCRIPTION

The proper selection must be made of solvent and catalyst in order to produce oligimers of the olefin starting material with a minimum of the disproportionation and isomerization that are found in oils of the prior art processes. The solvent serves as a polar solvent to solvate the intermediate carbonium ions formed during the reaction, and to complex the catalyst to give a catalytically active species which remains in the solvent phase. The nitromethane and nitroethane also dissolves appreciable amounts of monomer but little of the oils. This last property is believed to be partly responsible for the narrow molecular weight distribution obtained in the product when using these preferred solvents, which results in a more favorable product distribution. Suitable solvents for meeting the requirements for this purpose have been found to be nitromethane, nitroethane, nitropropane, nitrobenzene, benzene, lower alkyl benzenes and mixtures thereof. Suitable lower alkyl benzenes include toluene, the xylenes and ethyl benzene. Of these nitro compounds are preferred (with nitroethane being the especially preferred solvent). Reasonable yields of polyisobutylene oils having $KV_{210}$=1.5–20 and VTF-VI=95–115 can be prepared The preferred process for the preparation of these fluids involves the use of substantially anhydrous stannic chloride as catalysts and nitromethane (or nitroethane) as solvent. However, small amounts of water can act as reaction promoters.

The catalyst used in the preferred process (for making oils having an average molecular weight up to about 1000) is stannic chloride. The stronger Lewis acid catalysts such as aluminum chloride, aluminum bromide, titanium tetrachloride and antimony pentachloride, do not cause any appreciable polymerization of the monomers in nitromethane. Boron trifluoride in nitromethane gives an oil product from isobutene having a viscosity index of about 75. Stannic chloride does not catalyze the polymerization of these monomers satisfactorily in such solvents as ether, water, dioxane, acetic acid, acetone, acetonitrile, acetic anhydride, diethylene glycol monoethyl ether, chloroform, methyl acetate, dimethoxyethane, N-methyl-pyrolidione, and hexamethylphosphormaide.

This system is operated at low pressure near ambient temperature, gives high ratios of product to catalyst consumed, is highly selective for isobutylene while tolerating a wide variety of feed compositions, is easily controlled to give the desired products, and is well suited for continuous recycle operation.

Product isolation involves simple phase separation. The product distribution is sufficiently narrow that simple vacuum topping is required so no heavy by-products are formed. By-product dimer, trimer and tetramer have some commercial uses and are also readily cracked to isobutylene for recycle.

The most important reaction variables are the temperature and the rate of feed relative to the amount of catalyst present (which determines the reaction rate).

In general the temperature can be varied from −30°C to +100°C with from −30° to 50°C being the preferred range 0° to 35°C being an especially preferred range. Electrical oils are generally obtained at lower temperatures than those used in obtaining tractants. The volume of oil prepared is generally at least equal to the volume of solvent for a given run but the ratio of volume of oil prepared to volume of solvent present may easily exceed 10:1. When carrying out the process in a continuous operation by continuously removing the reaction medium and separating the product from the catalyst and solvent; the ratio of solvent to product generally is maintained at from 2:1 to 1:2.

The catalyst may be used in an amount equal from 0.1 to 40 volume percent of the solvent present, and preferably from 1 to 20 volume percent of the solvent present.

The concentration of the free monomer in the reaction medium is relatively small and can be controlled by the pressure maintained at given temperature for gaseous feeds, and by rate of addition for liquid olefin feeds, thus, controlling the molecular weight of the product. Generally pressures of from about 1 to 275 psi absolute have been found most suitable with from 10 to 100 psia being the preferred range.

The feed stock can vary from 5 to 100 percent vinylidene monomer (e.g. isobutylene), the remainder being any inert hydrocarbons. The presence of hydrocarbon non-vinylidene compounds is not detrimental since the vinylidene monomers as defined herein are selectively polymerized by the catalyst system. For instance, the efficiency of isobutene removal from mixtures of isobutene and other butenes and/or butanes depends on the particular process but is relatively insensitive to small amounts of impurities such as air, water, organo-sulfur or organo-nitrogen compounds.

Distillation to produce different oil compositions can give varying results depending on the vacuum, the apparatus, the distillation rate and the composition of the reaction product which is distilled. Under some conditions, considerable (>15%) trimer can be left when the oil is topped to 80°C, under other conditions little (<10%) of the trimer or tetramer will remain. More typically one-third of the tetramer remains in the oil, and two-thirds of the tetramer and nearly all of the trimer are removed. In addition, distillation is inherently limited by the thermal stability of the oil. At temperatures (of the overhead distillate) from 175 to 225°C, cracking of the oil can become so severe that the pressure starts to increase (usually the pressure is less than 1.0 mm Hg.

Vapor phase chromatograph (VPC) scans give good information on the relative amounts of dimer, trimer, etc. up to about $C_{48}$.

The oils produced by the process may have a number average molecular weight of from 224 to about 2,000. The preferred product contains principally the tetramer to decamer range. The tetramer in the present case consists predominantly of a major and a minor component. In the case of isobutene the hydrogenated major tetramer component has the structure:

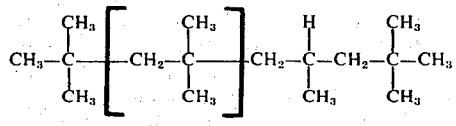

and the minor component has the structure:

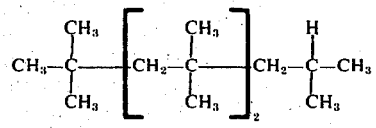

This latter type of structure predominates above the tetramer (i.e. at pentamer and above). The repeating unit for components of the pentamer and higher oligimers is indicated by the brackets in the formulae. The higher olefins such as 2-methylbutene-1 produce the corresponding regular structures when oligimerized in accordance with the previously described process conditions.

"Vinylidene" monomers suitable for preparing novel, "unisomerized" oligimer oils, by the process described herein, have the formula:

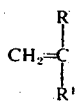

wherein —R is $—CH_3$ or $C_2H_5$ and $R^1$ is an alkyl group of from 1 to 10 carbon atoms.

These oligimers are useful in the "as produced" unsaturated forms as electrical oils. When the oils are to be used as traction fluids they may be hydrogenated using a conventional hydrogenation catalyst such as Raney nickel, platinum, palladium or rhodium to improve the oxidative stability thereof. However, the olefinic oils are relatively stable and do not require further treatment in order for them to be suitable for use as traction fluids. For most uses such as traction fluid the higher molecular weight product may be left with the tetramer to decamer range material, but the dimers and trimers should be separated therefrom along with the monomer. This is readily accomplished by distillation.

The oils as produced by the present process find particular advantage in their use as traction fluids (particularly in blends with saturated cyclic compounds) due to their high coefficients of traction and excellent viscosity-temperature properties. The requirements of a traction fluid are discussed in the U.S. Pat. Nos. 2,549,377; 3,440,894 and 3,411,369. Compounds described in the present application can be incorporated, as additives, to such prior art traction fluids. Exemplary tractive devices in which the traction fluids of the present invention find use are disclosed in U.S. Pat. Nos. 1,867,553; 2,871,714; 3,006,206 and 3,184,990.

Additionally these oils find use in caulks and as reactants, electrical oils, etc.

ILLUSTRATIVE EXAMPLES

EXAMPLE 1

A three-necked, one liter, round-bottomed flask was equipped with a mechanical stirrer, a gas inlet tube (which also serves for intermittent product removal), and a reflux condenser containing a thermometer which dipped into the liquid layer and was capped with a gas exit tube leading through a mercury bubbler to the atmosphere. Nitromethane (200 ml.) and stannic chloride (5 ml. = 11.15 g.) were added to the flask and the isobutylene flow started. The reaction was maintained at 3°±1°C with an ice bath. The rate of isobutylene addition as 7.2 g/min. which resulted in 8.5 ml/min. of product (density about 0.85) formation. At 20 minute intervals, the isobutylene feed and the stirrer were stopped and the layers permitted to separate. The top oil layer (170 ml.) was removed and the nitromethane (bottom) layer was returned to the reactor with 5 ml. (3 percent of product volume) fresh nitromethane added to compensate for solubility losses. After 4 20-minute runs, the reaction was stopped. The catalyst in the nitromethane layer was readily killed with water with some production of HCl fumes. No difficulty with an exotherm was encountered when killing the catalyst. The combined oil layers (665 ml. including 20 ml. nitromethane) were washed with water, with 5 percent sodium hydroxide solution, and twice more with water. A solvent such as pentane or hetane can be added to facilitate handling.

Although the oil of this example contains all of the novel polyisobutylene oligimers in the series $C_{16}$–$C_{20}$. . . $C_{48}^+$, fractional vacuum distillation can be used to obtain a fraction relatively pure in a given oligomer (e.g. $C_{16}$).

In the reaction of this example, small amounts of water in the catalyst and/or feed material can act as a reaction promoter. If extremely pure materials are used in the process, a small amount of water can be added to initiate or hasten the reaction. A lower alcohol (e.g. methanol) or acid (e.g. acetic acid) can also be used as such a promoter. Generally, the reaction rate can be increased (over anhydrous) by addition of 0.1–1.5 moles $H_2O$ per mole of $SnCl_4$.

Polyolefin products, such as that of this example, can contain residual tin and chlorine (e.g. 250–5000 ppm Cl). As is discussed in more detail hereinafter, these elements, particularly the tin, can be present as a metal-organic compound which imparts EP (extreme pressure lubricant) properties to the product. However, if one desires, the chlorine (e.g. 2000 ppm) can be removed from the product by heating the product with calcium oxide (lime) followed by filtration. Mild catalytic hydrogen treatment (e.g. 200 psi of $H_2$, 200°C, Harshaw NI-0104P catalyst)can also be used to reduce the tin and chlorine content to very low levels (e.g. Cl from 2000 ppm to 6 ppm).

The process of the present example can also be used to convert butadiene to trans-1,4- and 1,2-polybutadienes. This is surprising since prior art cationic catalyst systems convert butadiene to cyclized polymers.

1-Decene can also be polymerized with the catalyst system of the present example if $AlCl_3$ is substituted for $SnCl_4$, particularly to get high yields of a low viscosity oil. Oxygenated derivatives of these poly 1-decenes can be obtained by ozonolysis in a similar manner to the process of the next example.

EXAMPLE 2

Polyisobutylene oil from Example 1 (260 ml., 221.4 g.) and anhydrous methanol (800 ml.) were placed in a three-necked, two-liter, round-bottomed flask equipped with a gas inlet tube, a mechanical stirrer and a reflux condenser. The flask was maintained at about 0°C by means of an ice bath while an oxygen-ozone stream (5.2 millimoles $O_3$ per minute) was passed through for 150 minutes. After this time the product was given a "hydrolytic work-up," that is distilled water (300 ml.) was added and the mixture heated to reflux for 90 minutes. The oil layer was diluted with pentane (500 ml.) and successively extracted with about 250 ml. of water (twice); 5 percent ferrous sulfate solution; 5 percent sodium carbonate solution; water; 5 percent sodium carbonate solution; and water (twice).

The combined sodium carbonate and water extracts were acidified with concentrated hydrochloric acid and extracted with ether. After drying, the ether was removed to recover 8 g. (3.6 percent) of an acidic fraction.

The main pentane layer was dried over calcium chloride and the pentane removed on a steam bath to recover 194 g. (87.6 percent by weight) of a neutral fraction. The infrared spectral analysis of this material showed that it contained mainly carbonyl (aldehyde or ketone) functionality with smaller amounts of hydroxyl functionality. Analysis by gas-liquid chromatography showed that the composition of the product was essentially a repeating pattern of three major components in a given molecular weight range. It is possible that other components were not separated using 6-foot silicone oil columns and 6-foot polyethylene glycol columns. Several minor components were also detected. Very little unreacted oil was present. This product will be referred to sometimes hereinafter as "PIB-ketone" or "PIB-ketone, hydrolytic work-up."

EXAMPLE 3

The neutral product (PIB-ketone) of Example 2 was tested for its traction using a Roxana Four-Ball tester sold by Roxana Machine Works, St. Louis, Mo. It showed a traction higher than the original polyisobutylene (about 85 g. of torque versus about 72 g. initially) and higher than for commercially available polybutenes (about 66 g. of torque). This indicates that the product is useful as a traction fluid or as a component of a traction fluid.

EXAMPLE 4

The PIB-ketone of Example 2 was distilled under vacuum and separated into several fractions. One of these fractions was collected over the range of 80° to 110°C at 0.8 mm. Hg pressure. This fraction contained relatively few components. The individual components were isolated by gas-liquid chromatography and characterized by means of infrared, mass and nuclear magnetic resonance spectral data. The predominant component was

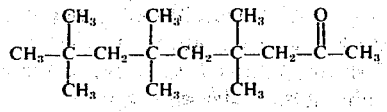

4,4,6,6,8,8-hexamethyl-2-nonanone. The two lesser components were identified as

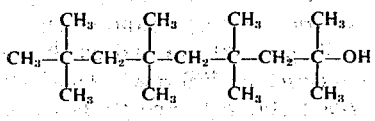

1,1,3,3,5,5,7,7-octamethyl-1-octanol and

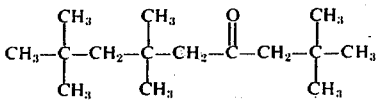

2,2,6,6,8,8-hexamethyl-4-nonanone.

The structural formulae of higher boiling fractions correspond to the above structures with an additional appropriate number (e.g. up to a total carbon number of at least about 49 for the ketones and at least about 50 for the alcohols) of

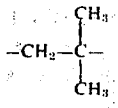

units inserted after the first t-butyl group. The "PIB-ketone" is therefore a mixture containing predominantly ketones (at least about 75 mole percent).

EXAMPLE 5

The neutral product (50 g.) of Example 2 was dissolved in 200 ml of diethyl ether and reacted with an excess of lithium aluminum hydride (8.0 g.) for four hours at reflux. The excess hydride was decomposed by reaction with ethyl acetate and 200 ml. of 15 percent hydrochloric acid was added cautiously. The ether layer was extracted twice with 250 ml. of water, dried over calcium chloride and the ether removed on a steam bath. The oily product (48 g., 96 percent by weight) was characterized as an alcohol by its infrared spectrum. No carbonyl absorption remained. Its gas-liquid chromatogram showed a repetition of two major peaks, the components having the same molecular weight no longer being separated by this column (6 feet of silicone rubber).

The alcohols which contain a large non-polar portion and a very polar alcohol portion are referred to sometimes hereinafter as "PIB-alcohol" and are useful as solvents and especially as components of traction fluids and as components in solvents for polymers such as polystyrene and polymethylmethacrylate. They are also useful as intermediates in the preparation of the corresponding acetate esters.

EXAMPLE 6

The alcohols of Example 5 (20 g.) were mixed with an excess (30 ml.) of acetic anhydride and heated on a steam bath for one hour. Excess water (100 ml.) was added to decompose the excess acetic anhydride. The mixture was heated for an additional hour. Ether (100 ml.) was added and the ether layer separated. The ether layer was extracted twice with approximately 100 ml. portions of water and then dried over calcium chloride. After the ether was removed, an infrared spectrum was obtained on the remaining 20 g. (100 percent by weight) of oil. The infrared spectrum showed the presence of carbonyl groups (ester) and the substantial absence of hydroxyl groups (alcohol). This ester was useful as a traction fluid, both alone and in blends (as with hydrogenated polyolefin oils or hydrogenated paraffinic or naphthenic lubes or with synthetic naphthenes or adamantanes). The ester is also useful as a component of a gear lube, especially a lubricant for a limited slip differential. Typically blended fluids or lubes can contain in the range of 1 to 95 percent of such an ester and 99–5 percent of one or a mixture of oils of the paraffinic, naphthenic or polyolefin classes (such oils can be partially or fully hydrogenated).

EXAMPLE 7

A solution was prepared in a two-liter flask by mixing hydroxylamine hydrochloride (100 g.), water (600 ml.), 10 percent sodium hydroxide solution (400 ml.), and ethanol (400 ml.). This mixture was stirred while the neutral ketone product (40 ml., 34 g.) prepared according to Example 2 was added. The resulting mixture was heated and stirred at 80°C for 30 minutes. The entire mixture was diluted with 1000 ml. water and extracted with 500 ml. ethyl ether. The ether layer was extracted twice more with 500 ml. portions of water. The ether layer was dried over calcium chloride and the ether removed on a steam bath. The resulting oil 28 g. (82.4 percent by weight) was found by infrared spectroscopy to contain oxime functions and substantially no unreacted carbonyl functionality. This oxime is soluble in paraffinic and naphthenic petroleum oils and is useful as a traction component or as a viscosity stabilizer for oil-extended unvulcanized rubber stock.

EXAMPLE 8

A three-liter, round-bottomed flask was equipped with a gas inlet tube, a mechanical stirrer and a reflux condenser. This was charged with acetic acid (1,500 ml.) and polyisobutylene oil (500 ml.) prepared according to Example 1. An oxygen-ozone stream (5 liters per minute, 5.3 millimoles ozone per minute) was passed through the mixture for 240 minutes. The temperature was maintained in the range of 25° to 50°C by means of a water bath. The reaction mixture was initially two phases, but became homogeneous near the end of the reaction time.

The crude mixture was then given an "oxidative work-up," that is, it was heated to 90° to 100°C and 30 percent hydrogen peroxide solution (500 ml.) was added cautiously over a period of 50 minutes. The mixture was then refluxed (about 110°C) for six hours. Ether (1000 ml.) and water (150 ml.) were added and the layers separated after stirring. The ether layer was washed twice with water and twice with 0.2 percent ferrous sulfate solution (500 ml. each). The ether layer was next washed with 10 percent sodium carbonate solution (500 ml.) and twice with water (1000 ml. each time). Since the sodium salt of the acid is much more soluble in water than in sodium carbonate solution, most of the separation occurs in the two water washes. The remaining ether layer was dried over calcium chloride and the ether removed on a steam bath to give the neutral ketonic fraction. Gas-liquid chromatography and infrared spectroscopy indicated that the product was similar to the produce of Example 2, but more complex and showing indications of significant isomerizations. This neutral fraction amounted to 232 g. (55.0 percent by weight) and is hereinafter sometimes referred to as "PIB-ketone, oxidative work-up."

The sodium carbonate extract and the two following water extracts were combined and made acidic by cautious addition of excess hydrochloric acid and extracted with diethyl ether (500 ml.). The ether layer was dried over calcium chloride and the ether removed on a steam bath. The resulting liquid acid fraction weighed 134 g. (32.3 percent by weight) and is hereinafter referred to sometimes as "PIB-acid." The infrared spectrum showed the absorbance bands characteristic of carboxylic acid functions.

Ten percent PIB-ketone in a hydrogenated solvent-refined paraffinic oil yields a torque transmission of 67 grams compared to 58 grams for the hydrogenated oil containing no additives. The "PIB-ketone, oxidative work-up" produces similar results.

Any of the polar compounds described herein perform as a traction improving additive in any petroleum oil (paraffinic or naphthenic), including oils produced by hydrocracking, or any compatible synthetic fluid (silicones, ester oils, polyolefins, fluorinated fluids).

The polar compounds can be used as extreme pressure additives and/or wear additives. The polar end of the molecule is apparently strongly attracted to the metal surface, resulting in less wear of the surface due to the protective action of the gem-structured "backbone."

EXAMPLE 9

The sodium salt of the acidic fraction can be readily obtained by proceeding according to Example 8 to the first water extraction following the 10 percent sodium carbonate extraction. When these two extracts were mixed, a phase separated. This can be diluted with diethyl ether and the phase separated. Drying over calcium chloride and removal of the ether on a steam bath results in a viscous liquid product which has an infrared spectrum consistent with a sodium carboxylate.

This product is useful as a detergent, as a surface active agent, and as a solubilizing agent. At least 20 percent diethyl ether can be dissolved in water containing a few percent of this salt.

The sodium salt can also be prepared directly from the acid and a suitable base under nearly anhydrous conditions. Salts of other metals, e.g. lithium, calcium, magnesium, barium, zinc and cobalt, can also be prepared in a similar manner. Such salts are useful in compounding greases, hydraulic oils, lube oils, etc. Such salts (e.g. $Na^+$) can be used to increase the viscosity and/or reduce acidity of lubricants, especially lubricants for traction or friction drives.

EXAMPLE 10

The acidic fraction prepared according to Example 8 (25 ml., 22.6 g.), methanol (200 ml.), and 96 percent sulfuric acid (30 ml.) were placed in a 500 ml. round-bottomed flask and refluxed for 6 hours. Water (200 ml.) and diethyl ether (200 ml.) were added and the layers separated. The ether layer was successively extracted with water, 10 percent sodium carbonate, and water using 200 ml. each time. The ether layer was dried over calcium chloride and the ether removed on a steam bath. The resulting neutral ester product weighed 18 g. (80 percent by weight) and is sometimes referred to hereinafter as "PIB-ester." Gas-liquid chromatography showed the repeating pattern to be three major components at each general molecular weight level. The repetitions were characterized by the four-carbon

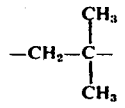

unit. Infrared analysis showed the absorbance expected for ester functionality and the absence of acid functionality.

The ester was useful as a traction fluid and as a component of blended traction fluids. Particularly useful blended base stock comprises 1 to 99 percent of the ester and from 99 to 1 percent of at least one naphthene or paraffin having an SUS viscosity at 100°F in the range of 25–25,000.

EXAMPLE 11

An acid (1 g.) prepared according to Example 8 was mixed with thionyl chloride (1 ml.) and carefully warmed on a steam bath until the bubbling subsided. It was then heated and a nitrogen flow maintained while the thionyl chloride evaporated. Finally, a water aspirator-produced vacuum was applied to the solution which was maintained at 80°–90°C for 5 minutes. An infrared spectrum on the oil product (which had a sharp odor) showed absorbance characteristics of acyl halides.

EXAMPLE 12

The acyl halide product of Example 11 was poured into methanol (25 ml.). Water (50 ml.) and diethyl ether (50 mol.) were added and the layers separated. The ether layer was extracted (once with 5 percent sodium carbonate [50 ml.] and twice with water [100 ml. each]). The ether layer was dried over calcium chloride and the ether removed on a steam bath. The resulting oily product was shown by gas-liquid chromatography and infrared spectroscopy to be identical with the PIB-ester of Example 10.

EXAMPLE 13

An acid (50 g.) prepared according to Example 8 and excess (20 g.) of 85 percent hydrazine hydrate (the remaining 15 percent being water) were mixed in a 250 ml. Erlenmeyer flask with magnetic stirring. The mixture immediately became warm. The temperature was then raised by external heating to 125°C and excess hydrazine fumed off in a well-ventilated hood. The temperature was maintained at 125°C for two hours then raised to 185° to 210°C for a further two hours. An infrared spectrum of the very viscous material showed that it was substantially converted to the acyl hydrazide derivative. The product was dissolved in diethyl ether (400 ml.) and extracted twice with water (500 ml. each time). Many of these extractions resulted in serious emulsion difficulties. Such emulsions were broken with concentrated sodium chloride solution, but separation times of one to two days were still occasionally required. The ether layer was dried over calcium chloride and the ether removed on a steam bath.

The product was very viscous and light orange in color. An infrared spectrum was again determined and showed somewhat sharper bands. The material was especially characterized by absorbances near 3.1M and 6.1M, typical of acyl hydrazides. This hydrazide was different from others because it was liquid, rather than solid, and was soluble in pentane, white mineral oil, and other hydrocarbons, but insoluble in water. This is to be contrasted with the hydrazide from oleic acid, which is solid and unsoluble in oil. Adipyl dihydrazide, acetyl hydrazide and benzoyl hydrazide are also solids which are soluble in water but insoluble in hydrocarbons. The hydrazide of this example is especially useful as a traction component, or as a viscosity stabilizer in oil-extended uncompounded synthetic rubbers because of these solubility properties. It is also useful as an emulsifying agent and as an antiozonant in rubber.

EXAMPLE 14

The acid (10 g.) prepared in Example 8 was dissolved in methanol (50 ml.) containing added water (1 mol.). Sodium borohydride (3 g.) was added in small portions over one hour. Ether (100 ml.) and water (100 ml.) were added and the layers separated. The ether layer was extracted twice more with water (100 ml. each) and the ether layer discarded. The combined water layers were cautiously acidified with concentrated hydrochloric acid and ether (100 ml.) was added. The layers were separated. The ether layer was extended with water (100 ml.), dried over calcium chloride and the ether removed. The resulting acid was converted to its corresponding ester by the procedures of Example 11 and 12. Gas-liquid chromatography showed that the middle component of the three major components described in Example 8 was considerably enhanced.

Since it is well known that sodium borohydride will not reduce carboxylic acids under these conditions but will reduce esters, ketones and aldehydes, it is reasonable to conclude that the center and largest component represents the original acidic component and the other peaks represent other carbonyl components not separated due to the previously mentioned strong solubilizing power of the sodium salt of the carboxylic acid.

EXAMPLE 15

The neutral ketone (10 g.) prepared according to Example 2 was slowly added to 85 percent aqueous acetic acid (100 ml.) containing chromic acid (2 g.) heated on a steam bath to around 90°C. This was left for two hours with occasional shaking. Then water (200 ml.) and ether (200 ml.) were added. The ether layer was extracted with water, 10 percent hydrochloric acid, 10 percent sodium hydroxide solution and twice with water. It was then passed over a 3 foot × 1 inch column of chromatographic grade alumina. The ether used for this elution was removed to leave a product of a dissolved salt of chromium (III). Gas-liquid chromatographic analysis showed that the resulting product was a substantially purified form of the indicated ketone:

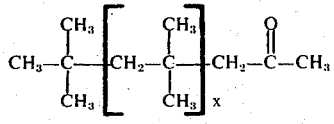

$x = 1–10$

The paramagnetic complex, europium (III) 2,2,6,6-tetramethylheptanedionate [tris(dipivalomethanato)-europium (III)], referred to hereinafter as $Eu(DPM)_3$), can be used as an NMR shift reagent and, thus, provides a means of characterizing oxygenated compounds, such as those of Example 4 and Example 15. $Eu(DPM)_3$ can be used to produce selective proton resonance shifts which accentuate chemical shift differences between geminal methyl and between isolated methylene groups, as in the highly branched alcohols and ketones.

EXAMPLE 16

The reaction product of Example 1 contains substantial amounts of tin and chlorine. More probably, the tin and chlorine are chemically combined, in a highly soluble and compatible form, with one or more isobutylene oligimers. In any event, the recovered polyisobutylene oil can also contain such tin and chlorine. Such a novel tin and/or chlorine containing polyisobutylene oil has improved antiwear properties (e.g. a 4-ball tester "wear-scar" in the order of 0.4 to 0.6 mm. compared to about 0.75 mm. for a solvent refined paraffinic lube of comparable viscosity). Chemical derivatives (such as those of the preceeding Examples 2 to 6 and 10) can also exhibit improved antiwear properties, which can be caused in whole or in part by inclusion of such tin and chlorine or, perhaps, the improved antiwear properties may be, in whole or in part, an inherent property of said derivative.

An antiwear additive (e.g for incorporation in conventional naphthenic distillate oils, hydrorefined oils, hydrocracked oils, white oils, solvent refined paraffinic oils or mixtures of two or more such oils) can be obtained from such reaction products (or tin and chlorine containing oils) by such means as extraction with a solvent (preferably acetone) for the presumed organo tin-chlorine complex. Preferred solvents comprise acetone, ethanol, methanol, methyl ethyl-ketone, dimethyl formamide, furfural, nitromethane, nitroethane, and the like; that is, solvents which will not dissolve the oil but will dissolve the more polar complex. Readily detectable antiwear protection is provided by such additives at concentration levels which impart 100 parts of tin per million parts of oil, with a typical range being 50 ppm. to 10 weight percent of tin.

Therefore, one aspect of the present invention is novel lubricating oil additives comprising the tin-containing products of the polymerization of isobutylene using stannic chloride catalyst, such polymerizations being carried out between −80°C and 100°C at a pressure from 0–250 psia. These additives can contain from 0.005 to 50 weight percent tin.

These compositions can also be used as additives to fuels (e.g. diesel oil, gasoline and jet fuel) to prevent wear.

A one-liter round bottom three-necked flask equipped with a mechanical stirrer and a thermometer was charged with nitroethane (200 ml.) and stannic chloride (5 ml. = 11.2 g.). The temperature was maintained at 30°C with an external ice bath while isobutylene was bubbled in for one hour. After this time the stirring was stopped and the upper oil layer (530 ml.) was separated from the lower nitroethane layer (160 ml.). After water washing and drying over calcium chloride, the oil layer was distilled to get a fraction boiling up to 82°C at 2 mm. Hg (which was discarded), a fraction boiling from 82°C at 2 mm. Hg to 175°C at 1 mm. Hg, $KV_{210°F}$ = 18.14 cSt.

In the same equipment, except that the flask had a volume of 500 ml., the charge was nitromethane (200 ml.) and stannic chloride (20 ml. = 44.6 g.). The temperature was maintained at 15°C for 21 minutes at the same rate of isobutylene addition used before. The upper layer was washed with water and dried over calcium chloride. It was then distilled to remove distillate boiling up to 80°C at 1 mm. Hg pressure. The remaining oil residue ($KV_{210°F}$ = 46.74 cSt) was saved for wear testing.

In the same equipment, the charge was nitromethane (200 ml.), pentane (200 ml.), stannic chloride (20 ml. = 44.6 g.) and water (150 microliters). The temperature was maintained at −10°C for 1 hour at the same rate of isobutylene feed. The mixture was allowed to stir for an additional 30 minutes. The oil product was washed and dried over calcium chloride. The pentane was removed under aspirator vacuum and the product distilled to a boiling point of 80°C at 1 mm. Hg, the small amount of the distillate being discarded. The bottoms ($KV_{210°F}$ about 420 cs) yield was about 500 ml. It contained 4.5 percent tin and 2.5 percent chlorine after filtration through distomatious earth at 80° to 100°C. This oil (100 ml.) was extracted three timmes with acetone (25 ml. each time). The extracts were combined and the acetone was removed by heating to 90°C under a stream of nitrogen. The extracted oil, about 90 ml., and the extract, 10 ml. had similar viscosities. The initial oil had 4.6 percent tin; the extracted oil had 1 percent tin; and the extract 33 percent tin. This oil and the extract, as with the other tin-containing products referred to above, can be added to lubricants to impart antiwear properties thereto.

EXAMPLE 17

A polyisobutylene oil (33 g., about 1 mole) prepared according to Example 1 was dissolved in carbon tetrachloride (150 ml.) and bromine was added dropwise to the stirred solution. White fumes could be seen above the reactor. These fumes tested very acidic on moist indicator paper. The fumes, caused by the presence of hydrogen bomide, indicate that a substitution reaction was occuring as well as the expected addition reaction. Bromine addition was continued until the color of unreacted bromine persisted for several minutes of warming. The total amount of bromine added was about 40 grams or 2½ times the theoretical amount needed for the addition reaction. The $CCl_4$ layer was extracted twice with water, once with sodium bisulfite solution (to remove the excess bromine) and twice more with water. The $CCl_4$ was removed by heating on a steam bath to leave a light brown oil, sometimes referred to hereinafter as "PIB-bromide." Its infrared spectrum showed CH, CC and CBr functionality. The oil was a source of active halogen and was found to be useful as an anti-weld component of cutting oils. The yield was 60 grams of isolated product oil. The chloride can also be prepared by a similar reaction of the olefin with chlorine and is useful as an EP additive, particularly in lubrication of a traction or friction drive. PIB-bromide (or individual bromated polybutenes) can be reacted with diamines or other polyamines (e.g. at reflux in dimethyl formamide solvent) to form an imine-amine, those of the following structure being especially good traction fluid components:

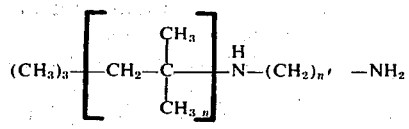

Preferably $n$ is 2–10 (e.g. 2) and $n'$ is 1–20 (e.g. 3). A preferred polar tractant is 5,5,7,7,9-hexamethyl-4-azadecylamine.

EXAMPLE 18

Polyisobutylene oil (330 g., about 1 mole) prepared according to Example 1 was mixed with maleic anhydride (100 g., about 1 mole) and heated to 225°C (attained over a period of about 1.5 hours) in a stirred flask equipped with a reflux condenser. The reaction could be followed by infrared spectroscopy. Over a period of time, the absorbance due to the double bonds in the oil disappeared. At the same time, the absorbances due to maleic anhydride diminished and new bands appeared. These still indicated an anhydride functionality. After six hours, the reaction was stopped and allowed to cool and stand overnight. The mixture developed some solid content during this time. Pentane (500 ml.) was added and the mixture cooled in ice to case additional precipitation. The solids were filtered from the mixture on a porous glass filter using a small amount of cold pentane to wash the solids. The white solid weighed 23 g. when dry and had an infrared spectrum which showed it to be unreacted maleic anhydride. The pentane was removed on a steam bath to give a very viscous, sticky oil. The yield was 400 g. The infrared spectrum of the derivatized oil showed a little remaining maleic anhydride, with a large amount of other anhydride, probably polyisobutylene succinic anhydride. This viscous oil was useful as a detergent, as an antiwear agent and as an intermediate in the production of a "hydrazide" derivative.

EXAMPLE 19

The product of Example 24 (42 g., about 0.1 mole) was stirred and 85 percent hydrazine hydrate (11.8 g., about 0.2 mole) was added. The temperature of the mixture rose to about 80°C during the addition. The resulting mixture was stirred for 1 hour, then heated to 150°C while nitrogen was passed through the mixture for 2 hours. This removed the excess hydrazine and converted the portion present as a salt into hydrazine. The resulting mixture was dissolved in ether and extracted with water to remove hydrazine and its salts. The ether was removed to leave a very viscous, sticky, yellow-brown oil (33 g. or 70 percent of theory). The infrared spectrum of this material was similar to the infrared spectrum of other acyl hydrazides. It is useful as a component of a traction fluid.

EXAMPLE 20

Polyisobutylene oil, produced as in Example 1, was fractionally distilled, at atmospheric pressure, to obtain a product which contained at least 80 weight percent of the $C_{16}$ isobutylene oligimer (i.e. "tetraisobutylene"). This predominantly $C_{16}$ fraction boiled in the range of 190° to 245°C and over 90 volume percent boiled at 240°C. Analysis by vapor phase chromatography showed that this predominantly $C_{16}$ fraction contained less that 10 weight percent $C_{12}$ oligimer and less than 10 weight percent of the $C_{20}$ and higher oligimers.

EXAMPLE 21

Twenty-two hundred and sixty ml. of winter strained lard oil were blended with 400 ml. of tetraisobutylene (prepared as in Example 20) in a 5-liter kettle equipped with a vibromixer. The mixture was heated to 250°F and the vibromixer operated at maximum speed. Sulfur (239 g.) was added and the temperature of the mixture raised to 375°F for 2 hours. The mixture was then cooled to 200°F and air was bubbled through the mixture by means of a glass tube at a moderate rate (below that at which splashing and agitation take place) for 1 hour. The resulting sulfurized oil was analyzed and found to contain 8.23 percent sulfur. A ten gram portion of the sulfurized oil was dissolved in 100 g. of a commercially available solvent refined paraffinic lube having a viscosity at 210°F of 40.45 SUS, an ASTM viscosity index of 104 and containing 12 percent aromatics (by ASTM D2007). The oil solution remained clear with no separation after being tested at 36°F overnight and for one week at room temperature.

EXAMPLE 22

Winter strained lard oil (2550 ml.) was blended with 450 ml. of 80+ percent pure triisobutylene (prepared by a distillation simlar to that used in Example 20 but at a lower temperature), in a 5-liter kettle equipped with a vibromixer. The mixture was heated to 250°F and the vibromixer operated at maximum speed. These conditions were maintained while 266 g. of sulfur were added over a period of 30 minutes. The temperature was raised to 375°F for 2 hours. The mixture was then cooled to 200°F for one hour and air was bubbled through the mixture by means of a glass tube at a moderate rate below that at which splashing takes place. The resulting sulfurized oil was analyzed and found to contain 8.6 percent sulfur as based on the total composition. A ten gram portion of the sulfurized oil was dissolved in 100 g. of the solvent refined paraffinic oil described in Example 27. The oil solution remained clear with no separation after being tested at 36°F overnight and for one week at room temperature.

EXAMPLE 23

A useful lubricant for a controlled-slip differential, and which is also useful for lubrication of a traction drive transmission, comprises a blend of the following (all hydrogenations are to at least 98 percent saturation):

| Volume % | Component | KV210°F. (c.s.) | KV100°F. (c.s.) |
|---|---|---|---|
| 7.0 | Hydrogenated Cosden SH06 Polybutene | 11.04 | 124 |
| 28.0 | Hydrogenated Cosden SH15 Polybutene | 33.5 | 744 |
| 31.6 | Hydrogenated Poly α-Methyl Styrene | 23.0 | 2463 |
| 21.0 | Hydrogenated Poly α-Methyl Styrene | 4.65 | 39.6 |
| 7.4 | Anglamol 93 (E.P. Additive) | | |
| 3.0 | Amoco 9000 (Dispersant) | | |
| 1.0 | Ultraphos 11, (Low Static Modifier) | | |
| 1.0 | Synthetic Sulfurized Oil of Example 21 or 22 | | |

The Ultraphos 11 additive is a surface-active, organic phosphate ester of a linear aliphatic, ethoxylated alcohol. The hydrogenated poly(alphamethyl styrene) is primarily in the hydrindan form. A useful fluid can also be formulated wherein the corresponding indan is substituted for some or all of the hydrindan. The dicyclohexyl alkane polymer forms are present as minor constituents of the hydrogenated poly(alphamethyl styrene). Operable fluids can be made using up to 100 percent of such "dumbbell" polymers.

Other hydrocarbons which can be present in such traction fluids (in addition to the previously mentioned oils, e.g. hydrogenated paraffinic or naphthenic lubes) can be made by interaction (as by alkylation) of isobutylene or polyisobutylene with naphthene hydrocarbons (such as adamantanes, hydrindanes or cyclohexene). Such isobutylene interaction products with adamantanes are described in Example 24.

EXAMPLE 24

Ethylaluminum sesquichloride (ml. of 25 vol. % solution) was added to a mixture of dimethyladamantane (50 ml.) and t-butylchloride (1 ml.). The mixture was maintained at 0°–5°C. while isobutylene (45 g.) was added as a gas. The reaction was killed with 5 ml. of water, extracted with water and distilled under vacuum. The distillation vessel was kept at 280°C. to crack any high boiling product. The overhead was at about 170°C. About half of the oil was cracked in this manner, the rest distilled without cracking. About 30 ml. of oil was obtained. It had $KV_{210}$ of 4.40 cs. and VTF-VI of 26. A similar run at −30°C. gave about 20 ml. (nearly all cracked) having $KV_{210}$ of 4.22 cs. and VTF-VI of 62. Infrared spectroscopic analysis indicated that the adamantane moiety was present in the product oil. This oil is useful as a traction fluid or as a component of a traction fluid. The structure of one of the more important components of such a fluid is the following:

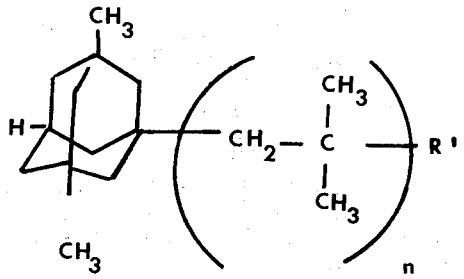

where $n$ is an integer from 1 to about 20 and R′ is

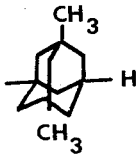

or one of the olefinic terminal groups previously referred to under the heading "Summary of the Invention."

The adamantane compounds containing such olefinic terminal groups can be converted to polar compounds (as by the reaction of the examples) containing any of the previously described functional groups.

EXAMPLE 25

3-Cyclohexyl-1,1,3-trimethyl indan can be used as a traction fluid base stock component. The structural formula of this compound is (I).

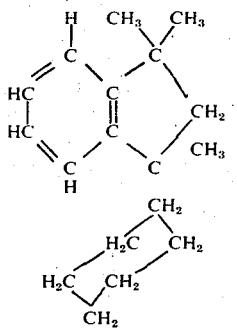

(I)

This compound was prepared in a one liter steel, rocker bomb which was charged with solid $\alpha$ -methylstyrene, 100 g. indan dimer (3-phenyl-1,1,3-trimethylindan), and 2 g. 5% rhodium-on-carbon catalyst (Englehart Industries). The bomb was charged with 1700 psig. hydrogen and heated to 100°C. The pressure dropped to 400 psig. after 1.5 hours. The bomb was cooled and the contents mixed with pentane. The pentane solution was passed through a silica gel column (2 ft. × 2 in.) and eluted with more pentane. The first two fractions (9 g. total) were the fully hydrogenated hydrindan derivative. The next 5 fractions contained 80 g. of the above compound I. About 10 g. of unreacted starting material was recovered by further elution. The structure of I was determined by a combination of infrared analysis, NMR spectroscopy, and mass spectrometry. The purity by VPC analysis was ≈80%. The oil had a $KV_{210°F.}$ of 3.24 cs.; a $KV_{100°F.}$ of 25.17 cs. and VTF-VI of -139. The 3-cyclohexyl-1,1,3-trimethylindan was tested for traction using the Roxana Four Ball Tester. The torque value for this sample was 68 g. The corresponding value for the fully hydrogenated material (hydrindan derivative) was 70 g. The unhydrogenated sample has a torque value of 59 g. The precision of a single value in this test is ± 1–2 grams.

EXAMPLE 26

1,1,3-Trimethyl-3-(2,2-dimethyl propyl) hexahydroindan can be used as a component of a hydrocarbon base stock for use in compounding a lubricant for a traction or friction drive. This compound was readily prepared by hydrogenation of the corresponding indan. This compound is especially remarkable because of its low viscosity compared to the corresponding compound in the $\alpha$ -methyl styrene dimer series ($KV_{210}$ about 1/2 as much) and its viscosity index which is much higher than the parent compound. The fully saturated and the aromatic version have about the same traction properties.

1,1,3-Trimethyl-3-(2,2-dimethylpropyl) indan (80 ml.) prepared as previously described in Example 25 was placed in a 300 ml. rocker bomb with 2 g. 5% rhodium-on-carbon. The bomb was charged to 1,500 psig. with hydrogen and heated to 200°C. After 6 hours the bomb was cooled and the oil removed and filtered. The crude product had a $KV_{210°F.}$ of 1.86 cs.; a $KV_{100°F.}$ of 5.91 cs. and VTF-VI of 108. Since there appeared to be a small amount of volatile material present (probably caused by cracking during the hydrogenation), the sample was topped to 60° at 0.2 mm. Hg pressure. Only about 2–5 ml. of distillate was collected. The viscosity properties were $KV_{210°F.}$ of 1.91 cs.; a $KV_{100°F.}$ of 6.46 cs. and VTF-VI of 85. The sample contained at least 60% bis-trans isomers of the structural formula II.

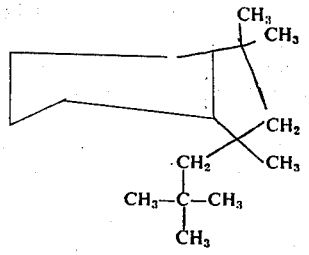

II

The compound was tested for traction using the Roxana Four Ball Tester, modified to show torque measurements. The torque for this sample was 65 g. The corresponding torque for unhydrogenated $\alpha$ -methylstyrene dimer is 59 g. The precision of the test is about ± 1–2 g.

EXAMPLE 27

400 ml. nitromethane and 300 ml. distilled isobutylene trimer were placed in a one-liter flask and heated to 85°C. 6 ml. of $SnCl_4$ were added. Then 75 ml. of $\alpha$ -methylstyrene were added dropwise over 35 minutes. The temperature quickly rose to 95°C. and was kept there. After the addition was complete, the mixture was stirred at 95°C. for an additional 10 minutes, then cooled to room temperature. The upper oil layer was separated and washed twice with water, the water layers being discarded. The oil layer was dried over $CaCl_2$ and distilled, and the 80 ml. of product that boiled from 60°–100°C. at 0.5 mm. Hg. pressure was retained. The major component (about 60 vol. %) was identified as III by a combination of infrared, NMR, and mass spectroscopy. It had a $KV_{210°\ F.}$ of 1.65 cs.; a $KV_{100°\ F.}$ of 5.69 cs. and a VTF-VI of -2.

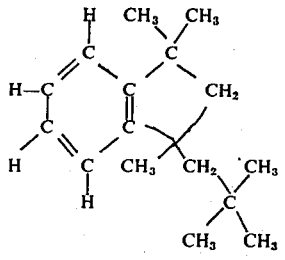

III

The same compound could be made using diisobutylene.

The compound, 1,1,3-trimethyl-3-(2,2-dimethylpropyl) indan, can be used as a component of a hydrocarbon traction fluid base stock (e.g., that of Example 23).

This compound was prepared as described below. Although fairly pure isobutylene trimer was charged, the major product was apparently derived from isobutylene dimer. The following equilibrium is properly involved:

$$C_{12}H_{24} \overset{cat}{\rightleftharpoons} C_{12}H_{25}^{+} \rightleftharpoons C_8H_{16} + C_4H_9^{+}$$

where $C_8H_{16}$ is $(CH_3)_3C{-}CH_2{-}C(CH_3){=}CH_2 \rightleftharpoons (CH_3)_3C{-}CH{=}C(CH_3)_2$ (A) (B)

Stannic chloride in nitromethane under certain conditions will rapidly polymerize some olefins, but not isobutylene oligomers (indeed, not most olefins, including polar olefins, such as methylmethacrylate). Styrene, $\alpha$ -methylstyrene, isoprene, butadiene, isobutylene, 2-methylbutene-1, are olefins that can be polymerized. If the $\alpha$ -methylstyrene cation can be generated in the presence of a large excess of the other olefin, addition should be the predominant reaction. Running the reaction under conditions known to give the indan dimer with $\alpha$ -methylstyrene produces substituted indans. The compound of this example has a remarkably low viscosity and high viscosity index compared to the corresponding $\alpha$ -methylstyrene dimer derivatives.

The compound was tested for traction using the Roxana Four Ball Tester. The torque for this sample was 63 g.

Table III presents Roxana Four Ball Torque data for a number of polar compounds previously described herein.

Table IV presents the structural formulae of a number of cyclic polar compounds which are useful as components of lubricants for a traction transmission or a friction drive. These components are especially useful when present in the range of about 0.5 to 10 weight percent in a base lubricant comprising at least one fully or partially hydrogenated oil selected from polymers of styrene (or of substituted styrene, such as $\alpha$ -methylstyrene), polyolefins, naphthenic and paraffinic lubes. Such polar compounds can also be used in such lubricants which also contain from 0.1 to 95 percent of the gem-structured polar compounds previously referred to herein. Sebacate esters (such as dioctyl sebacate or dibutyl sebacate) can be used as polar components (in the 0.5 to 10 weight percent range) of lubricants (as those referred to above) for a traction or friction drive. For example, up to about 7 volume percent of such esters can cause a significant increase in the traction coefficient of the blend of hydrocarbon base oils disclosed in Example 23 hereof, or in the entire lubricant composition disclosed in Example 23.

The ozone treatment described in Example 2 can also be used to improve the initial and aged (with copper ASTM D1934-B) power factors of hydrorefined mineral oils, used as electrical hydrorefined naphthenic oils having a SUS viscosity in the range of 40–20,000 SUS at 100°F. For Example, a 2000 SUS (at 100°F) hydrorefined (625°F, 1000 psig of 100 percent $H_2$, 0.3 LHSV, sulfided Ni, Mo oxides on $Al_2O_3$) naphthenic distillate was contacted with 0.5 weight percent ozone to produce a dark colored oil which, after 96 percent $H_2SO_4$ treatment, washing, neutralizing and adsorbent contacting (to remove the dark products), produced a good cable oil.

Methods for analysis of the branched olefin and paraffin oils described herein (as in Example 1) can be found in J. Poly. Sci, part A-1, volume 9, pp. 717–745 (March 1971).

EXAMPLE 28

Nitromethane (200 ml.) and $SnCl_4$ (5 ml.) are stirred in a three-necked, round-bottomed flask (500 ml.) equipped with a gas inlet tube, mechanical stirrer, reflux condenser, external bath and thermometer, while isobutene is passed into the mixture kept at 36°C. The isobutene is feed to the flask at a rate sufficient to maintain no flow on the outlet side after air has been swept from the flask. After 26 minutes the isobutene flow is stopped and the contents of the flask transferred to a separatory funnel. Conversion of the isobutene is quantative. After allowing five minutes for phase separation, the nitromethane layer (202 ml.) is drained from the bottom of the funnel. The oil layer (235 ml.) is washed twice with saturated aqueous sodium chloride solution, once with 5 percent aqueous sodium chloride solution and twice more with saturated aqueous sodium chloride solution. The oil layer is then dried over anhydrous calcium chloride and placed in a vacuum distillation apparatus. It is distilled to remove all material boiling below 80° at 0.5 mmHg. The remaining oil fraction (100 ml.) has the following properties:* $KV_{210°F}$=4.25 cs, $KV_{100°F}$=22.42 cs, VTF-VI = 98 ASTM-VI = 104. The distillate (100 ml.) was approximately (by VPC) 49 percent trimer and 49 percent tetramer. Any dimer-would have been lost to the trap (10 ml.). The loss on batch drying is about 30 ml.

as used herein KV stands for Kinematic Viscosity as determined by ASTM D 445

EXAMPLE 29

Example 28 was repeated except that the oil was distilled, collecting as the oil fraction the portion boiling from 80° to 200°C. This had the following properties: $KV_{210°F}$ = 3.23 cs, $KV_{100°F}$ = 14.09 cs, VTF-VI - 105, ASTM-VI - 104. This illustrates that the high viscosity index of the product is not due to a wide blending range of product molecular weight.

EXAMPLE 30

A polymerization is carried out as in Example 28 except that the reaction temperature is maintaned at 25°C. Again, 235 ml. of product is obtained in 26 min. The distillation gives 33 ml. of low boiling distillate (40 percent trimer, 57 percent tetramer) and 188 ml. remaining oil. This oil is percolated through about 12 in. of a column packed with activated alumina. The resulting oil is completely clear and has the following properties: $KV_{210°F}$ = 13.56 cs, $KV_{100°F}$ =0 145.2 cs, VTF-VI = 96, ASTM-VI = 96.

Any of the polyolefin oils of the present invention can be partially or fully hydrogenated by known methods (e.g. palladium on charcoal catalysts, 2,500 psi hydrogen, at 274°C) to improve their stability. The polyolefin oils or hydrogenated oils can be fractionally distilled under vacuum at from 40 to 250°C. Distillate fractions covering the complete boiling range can be taken as feed stocks from which individual hydrocarbon species (olefins or paraffins) can be recovered.

The major branched hydrocarbon species of the distillate fractions can be separated and isolated into chromatographic fractions of reasonably high purity by linear temperature programmed and isothermal gas chromatography. In most cases, chromatographic fractions representative of a single molecular species of each carbon number can be obtained using silicone rubber columns under isothermal conditions ranging from 210° to 280°C. In certain instances fractions consisting of hydrocarbons having several different carbon numbers have been prepared using such columns, These concentrates can then be rechromatographed over analytical columns and pure chromatographic fractions of single carbon number species collected.

EXAMPLE 31

A polyisobutylene oil was prepared by thoroughly vacuum cracking commercial polyisobutylene (having a number average molecular weight of 23,000) in a stirred, round bottom flask at about 375°C and 1 mm Hg. The product was taken overhead continuously with essentially no reflux or fractionation. The distillate products and traps were combined and redistilled at 100°C at 0.3 mm. Hg and the more volatile distillate fractions discarded. The remaining less volatile, thermally cracked polyisobutylene "bottoms" fraction, which represented about 35 to 40 percent of the total charge, can be used as an olefin oil to make polar compounds, as in the reactions of Examples 2, 5 to 19, 21 and 22. Fractions, as by non-distructive distillation, of such bottoms can also be used to make such polar compounds.

EXAMPLE 32

The "thermally cracked" polyisobutylene oil of Example 29 was hydrogenated in a 1 liter stainless steel hydrogenation reactor at 2,500 psi hydrogen and 274°C for 6 hours. The catalyst was 0.5 percent palladium on 4 to 8 mesh coconut charcoal.

A gas chromatogram of the hydrogenated, thermally cracked polyisobutylene contains a series of peaks which represent a homologous series of two different basic classes of branched hydrocarbons. One class is symmetrical, has an odd number of carbon atoms, and is terminated with two isopropyl groups. The second species is non-symmetrical, consists of an even number of carbon atoms, and is terminated with an isopropyl group and a tertiary butyl group. The incremental increase of carbon number for each series is due to an additional $C_4$, isobutylene, unit in the hydrocarbon chain. No significant amounts of the odd carbon numbered species which are terminated with two tertiary butyl groups were found to be present in these nonvolatile fractions. In the $C_{11}$ to $C_{40}$ range, the concentrations of the $C_{11}$ and $C_2$ species were much lower relative to the concentration of higher carbon numbered species, probably due to the loss of a portion of these hydrocarbons to the volatile fractions. The purity and molecular weight data obtained for each collected hydrocarbon species, $C_{11}$ to $C_{40}$, are given in Table I. The purity of these fraction varied from 96.7 to $99^+$ percent and the calculated molecular weight of each carbon number species was in good agreement with the experimental molecular weight value obtained using vapor pressure osmometry.

The identify of these branched hydrocarbons, as determined by MNR spectroscopy, are indicated by the structural assignments shown in J. Poly. Sci. part A-1, Volume 9, pp. 717 to 745 (March, 1971). The observed resonance positions in $CCl_4$ and assignments for the methylene and methyl protons of this series of hydrocarbons are summarized in the above paper. Methyl and methylene protons of the same type and having the same degree of steric hinderance and "crowding" were found to have essentially the same chemical shifts in $CCl_4$ for each individual hydrocarbon species regardless of carbon number. Differentiation and assignment of a number of the maximally crowded methylene and maximally crowded geminal dimethyl groups in these compounds was possible from 100-MHz spectra obtained using $C_6D_6$ solvent. The observed proton resonance positions for these groups in $C_6D_6$ and their assignment in the $C_{19}$ to $C_{40}$ hydrocarbon species are summarized in the above paper.

Table II gives the refractive indices determined at 25°C for the $C_{11}$ to $C_{40}$ hydrocarbon species. These values are compared with the calculated values obtained for these compounds using the Greenshields and Rossini method. The difference in refractive indices, ΔRI, (calculated minus experimental) was found to increase with increasing carbon number. Included also in this table are density values which were obtained from the calculated molal volumes (25°C) of these hydrocarbon species and two experimental density values which were determined for the $C_{35}$ and $C_{36}$ species. Positive deviations between calculated and observed density values were found for the $C_{35}$ and $C_{36}$ hydrocarbon species.

Substantially pure olefin species can be obtained and characterized in a similar manner from the unhydrogenated polyisobutylene oils.

The novel branched paraffin and olein hydrocarbon species are characterized by crowded and sterically hindered methyl and methylene groups. This crowding effect, although somewhat less pronounced in the lower carbon number species, becomes significantly greater with an increase in the carbon chain. The introduction of methylenes between two internal geminal methyl groups or between an internal geminal methyl and a t-butyl group ($\alpha$ to each group) causes significant bending of the hydrocarbon chain. This bending results in much greater crowding and steric hinderance of the various protons which in turn restrict free rotation of the individual methylene and geminal methyl groups. Resulting anisotropy changes cause a downfield chemical shift of their proton resonance signals.

The lower limit of this downfield shift in branched paraffins ($CCl_4$ solutions) is 66 Hz (1.10 ppm) for internal geminal methyls and 85 Hz (1.42 ppm) for isolated methylenes. This occurs in the polymer, polyisobutylene, where the repeating isobutylene unit provides maximum crowding of both the geminal methyl and the isolated methylene groups. The lower carbon number, $C_{11}$, $C_{12}$ and $C_{15}$, branched hydrocarbon species have no maximally crowded geminal methyl groups.

The $C_{16}$ hydrocarbon species is characterized by having both crowded and maximally crowded geminal methyl groups. This is the first molecular species in this series of compounds which has maximum crowding of a geminal methyl group. A geminal methyl group has maximum crowding when it is (1) adjacent, $\alpha$, to two isolated methylene groups and (2) beta, $\beta$, to two quanternary carbon atoms. This crowding is comparable to the maximum crowding of geminal methyls of high molecular weight (e.g. 200,000+) polyisobutylene. The resonance signal for the maximally crowded geminal methyl, like the resonance signal for the maximally crowded geminal methyls of polyisobutylene, is shifted downfield and appears at 65–66 Hz (1.08–1.10 ppm). The two isolated methylenes in this molecule (referred to as the terminal isolated methylenes in the longer carbon chain species) are both adjacent to a maximally crowded geminal methyl group and are, therefore, more sterically hindered and crowded than the isolated methylenes of the $C_{12}$ and $C_{15}$ species. This increased methyl crowding causes a 5 Hz downfield shift of the methylene resonance to 80 Hz (1.33 ppm), where one single resonance peak is observed for both isolated terminal methylene groups. These methylene groups are defined as crowded methylenes and are found in all of the higher carbon number species ($C_{16}$ and above).

The $C_{19}$ hydrocarbon species is the only other compound in this series which has a single maximally crowded geminal methyl group. This molecular species, which is symmetrical about the maximally crowded geminal methyl group, has two isolated methylenes, having exactly the same molecular environment. These groups are, therefore, magnetically equivalent. The NMR spectrum of the $C_{19}$ species in both $CCl_4$ and $C_6D_6$ solvents show a single proton resonance peak for these crowded methylenes. All of the odd carbon numbered species in this series are characterized by this molecular symmetry and have terminal isolated crowded methylene groups which are identical. The unsymmetrical $C_{20}$ hydrocarbon species is the first species of this hydrocarbon series which has a maximally crowded methylene group. An isolated methylene group has maximum crowding when it is adjacent to, or between, two maximally crowded geminal methyl groups such as in polyisobutylene.

The subsequent higher carbon numbered novel hydrocarbons ($C_{23}$ to $C_{40}$) have an increasing number of maximally crowded geminal methyl and maximally crowded methylene groups, and consist of two basic species (1) and odd carbon numbered species terminated with two isopropyl groups and symmetrical about either a maximally crowded geminal methyl group or a maximally crowded methylene groups and (2) an even carbon numbered species terminated with both an isopropyl and t-butyl group and without a center of symmetry. The $C_{23}$ and $C_{24}$ species are illustrated below where A refers to maximally crowded geminal methyl groups and B corresponds to maximally crowded methylene groups.

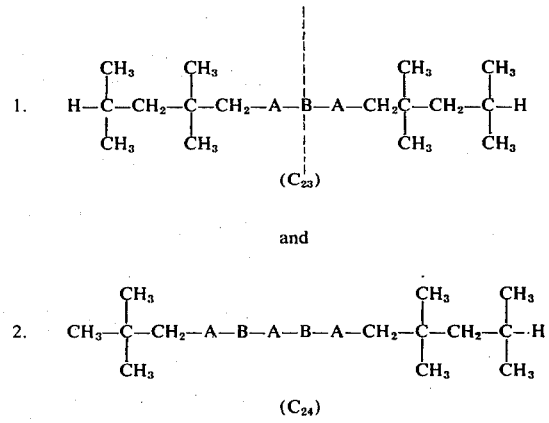

Integrated intensities of the observed resonance for each carbon number species were consistent for the theoretical number of maximally crowded methylenes and maximally crowded geminal methyls predicted for each assigned structure. The number of maximally crowded methylene groups is always one less than the number of maximally crowded geminal methyl groups. Further details of the characterization of compounds containing side groups can be found in the J. Poly. Sci. paper.

TABLE 1

Purity and Molecular Weight Data for Collected Fractions

| Carbon No. | Purity, %[a] | Molecular Weight Calculated | Molecular Weight Observed[b] | Relative Error, % |
|---|---|---|---|---|
| 11 | 99+ | 156.3 | 161 | +3.0 |
| 12 | 97.5 | 170.3 | 177 | +3.9 |
| 15 | 99+ | 212.4 | 214 | +0.7 |
| 16 | 99+ | 226.4 | 219 | −2.8 |
| 19 | 99+ | 268.5 | 271 | +0.9 |
| 20 | 99.0 | 282.5 | 275 | −2.7 |
| 23 | 96.7 | 324.6 | 322 | −0.8 |
| 24 | 96.9 | 338.6 | 344 | +1.4 |
| 27 | 99+ | 380.7 | 377 | −1.0 |
| 28 | 99+ | 394.7 | 397 | +0.6 |
| 31 | 98.8 | 436.8 | 426 | −2.5 |
| 32 | 98.7 | 450.8 | 444 | −1.5 |
| 35 | 97.3 | 492.9 | 490 | −0.6 |
| 36 | 99+ | 507.0 | 513 | +1.2 |
| 39 | 99+ | 549.0 | 544 | −0.9 |
| 40 | 99+ | 563.1 | 570 | +1.2 |

[a]Capillary gas chromatography.
[b]Vapor pressure osmometry.

TABLE II

Physical Property Data

| Carbon No. | Refractive Index RI Calculated[a] (25°C) | Observed (25°C) | ΔRI (Calc.-obs.) | Calculated[b] Density (25°), g/cc |
|---|---|---|---|---|
| 11 | 1.4143 | 1.4165 | −0.0022 | 0.7375 |
| 12 | 1.4254 | 1.4257 | −0.0003 | 0.7561 |
| 15 | 1.4380 | 1.4380 | — | 0.7816 |
| 16 | 1.4460 | 1.4441 | +0.0019 | 0.7942 |
| 19 | 1.4533 | 1.4530 | +0.0003 | 0.8092 |
| 20 | 1.4592 | 1.4564 | +0.0028 | 0.8185 |
| 23 | 1.4636 | 1.4615 | +0.0021 | 0.8282 |
| 24 | 1.4684 | 1.4648 | +0.0036 | 0.8355 |
| 27 | 1.4713 | 1.4679 | +0.0034 | 0.8419 |
| 28 | 1.4753 | 1.4704 | +0.0049 | 0.8479 |
| 31 | 1.4772 | 1.4725 | +0.0047 | 0.8525 |
| 32 | 1.4805 | 1.4750 | +0.0055 | 0.8575 |
| 35 | 1.4818 | 1.4768 | +0.0050 | 0.8607[c] |
| 36 | 1.4849 | 1.4780 | +0.0069 | 0.8651[d] |
| 39 | 1.4856 | 1.4798 | +0.0058 | 0.8674 |
| 40 | 1.4881 | 1.4815 | +0.0066 | 0.8712 |

[a]See Greenshields and Rossini
[b]From calculated value of molal volume at 25°C
[c]Observed value = 0.8584 g/cc.
[d]Observed value = 0.8631 g/cc.

TABLE III

ROXANA 4-BALL TESTING

| | Sample Designation | Running Time | Traction (grams of torque) | $KV_{210}$ | $KV_{100}$ | VTF VI | Scar |
|---|---|---|---|---|---|---|---|
| 1. | PIB (Starting material) | | 73.3 | 4.49 | 24.14 | 101 | Med. |
| | | ½ min | 72.8 | | | | |
| | | 1 min | 73.9 | | | | |
| 2. | PIB-Ketone (Batch I) (Oxidative Work-Up) | | 83.2 | 3.97 | 21.14 | 88 | Med. |
| | | ½ min | 82.5 | | | | |
| | | 1 min | 84.0 | | | | |
| 3. | PIB-Ketone (Batch I) (Oxidative Work-Up) | | 84.4 | (See No. 2) | | | Med. |
| | | ½ min | 83.0 | | | | |
| | | 1 min | 85.8 | | | | |
| 4. | PIB-Ketone (Batch I) (Oxidative Work-Up) | | 83.8 | (See No. 2) | | | Med. |
| | | ½ min | 82.5 | | | | |
| | | 1 min | 85.2 | | | | |
| | | 1½ min | 85.9 | | | | |
| | | 2 min | 86.9 | | | | |
| 5. | PIB-Ketone (Batch 2) (Oxidative Work-Up) | | 75.9 | | | | Med. |
| | | ½ min | 73.9 | | | | |
| | | 1 min | 77.8 | | | | |
| | | 1½ min | 82.8 | | | | |
| | | 2 min | 85.5 | | | | |
| 6. | PIB-Ketone (Batch 2) (Oxidative Work-Up) | | 74.0 | | | | Med. |
| | | ½ min | 71.4 | | | | |
| | | 1 min | 76.5 | | | | |
| | | 1½ min | 80.5 | | | | |
| | | 2 min | 82.3 | | | | |
| 7. | PIB-Ketone (Batch 2) (Oxidative Work-Up) | | 77.5 | | | | Med. |
| | | ½ min | 71.5 | | | | |
| | | 1 min | 83.5 | | | | |
| | | 1½ min | 85.5 | | | | |
| | | 2 min | 89.2 | | | | |
| 8. | PIB-Ketone (Hydrolytic Work-Up) | | 72.6 | | | | Med. |
| | | ½ min | 71.9 | | | | |
| | | 1 min | 73.4 | | | | |
| 9. | PIB-Ketone (Hydrolytic Work-Up) | | 71.3 | | | | Slight |
| | | ½ min | 70.9 | | | | |
| | | 1 min | 71.7 | | | | |
| | | 1½ min | 72.3 | | | | |
| | | 2 min | 73.5 | | | | |
| 10. | PIB-Ketone (Hydrolytic Work-Up) Composite | | 74.6 | | | | Very Slight |
| | | ½ min | 74.5 | | | | |
| | | 1 min | 74.7 | | | | |
| | | 1½ min | 75.2 | | | | |
| | | 2 min | 75.4 | | | | |

"Med." is an abbreviation for "Medium".

| | | | | | | | |
|---|---|---|---|---|---|---|---|
| 11. | PIB-Ketone (Hydrolytic Work-Up) (Metal Catalyst) | | 74.2 | | | | Very Slight |
| | | ½ min | 74.2 | | | | |
| | | 1 min | 74.1 | | | | |
| | | 1½ min | 74.9 | | | | |
| | | 2 min | 75.4 | | | | |

TABLE III-continued

| | Sample Designation | ROXANA 4-BALL TESTING Running Time | Traction (grams of torque) | $KV_{210}$ | $KV_{100}$ | VTF VI | Scar |
|---|---|---|---|---|---|---|---|
| 12. | PIB-Ketone (Hydrolytic | | 71.9 | | | | Slight |
| | Work-Up)(High Temp.) | ½ min | 71.5 | | | | |
| | | 1 min | 72.2 | | | | |
| | | 1½ min | 73.0 | | | | |
| | | 2 min | 74.3 | | | | |
| 13. | L-10-Ketone (Hydrolytic | | 63.0 | 6.86 | 57.8 | 67 | Med. |
| | Work-Up)(Indopol Poly- | ½ min | 63.0 | | | | |
| | butene) | 1 min | 62.9 | | | | |
| | L-10-Ketone | | 70.8 | | | | Large |
| | | ½ min | 67.6 | | | | |
| | | 1 min | 73.9 | | | | |
| | | 1½ min | 77.9 | | | | |
| | | 2 min | 78.5 | | | | |
| | | 2½ min | 79.9 | | | | |
| 15. | L-10-Ketone | | 72.1 | (See No. 14) | | | Large |
| | | ½ min | 68.7 | | | | |
| | | 1 min | 75.5 | | | | |
| | | 1½ min | 76.3 | | | | |
| | | 2 min | 77.5 | | | | |
| 16. | PIB-(Ketone/Acid) 75% | | 75.5 | | | | Med. |
| | (25% - PIB) | ½ min | 74.8 | | | | |
| | | 1 min | 76.2 | | | | |
| 17. | PIB-Acid | | 74.0 | 17.51 | 377.9 | 25 | Slight |
| | | ½ min | 73.9 | | | | |
| | | 1 min | 74.2 | | | | |
| 18. | PIB-Alcohol (75%) | | 70.8 | | | | Very |
| | (25% - PIB) | ½ min | 69.9 | | | | Slight |
| | | 1 min | 71.8 | | | | |
| 19. | PIB-Ester | | 81.4 | | | | Ex- |
| | | ½ min | 80.6 | | | | tremely |
| | | 1 min | 82.2 | | | | Slight |
| 20. | PIB-Ester + 10% K0880* | | 71.7 | | | | Very |
| | | ½ min | 71.9 | | | | Slight |
| | | 1 min | 71.6 | | | | |
| 21. | PIB-Br | | 69.1 | | | | Very |
| | | ½ min | 69.1 | | | | Large |
| | | 1 min | 69.1 | | | | |
| 22. | 40 PIB-Ketone | | 77.2 | | | | |
| | 60 Polybutene | ½ min | 76.5 | | | | |
| | | 1 min | 78.0 | | | | |
| 23. | No. 22 + 12% K0880 | | 68.5 | | | | Slight |
| | | ½ min | 68.6 | | | | |
| | | 1 min | 68.4 | | | | |
| 24. | 10 PIB-Ketone | | 66.6 | | | | Large |
| | 90 H.P.O.** | ½ min | 65.5 | | | | Scar |
| | | 1 min | 67.7 | | | | |
| | H.P.O.** | | 57.9 | 3.99 | 20.51 | 96 | Large |
| | | ½ min | 57.7 | | | | |
| | | 1 min | 58.2 | | | | |
| | Polybutene | | 67.5 | 3.34 | 16.36 | 82 | Med. |
| | | ½ min | 67.7 | | | | |
| | | 1 min | 67.2 | | | | |
| | PAMVCH*** | | 75.4 | 6.83 | 97.87 | −72 | Med. |
| | | ½ min | 74.7 | | | | |
| | | 1 min | 76.2 | | | | |
| | | 1½ min | 75.9 | | | | |
| | | 2 min | 76.2 | | | | |

*K0880 is a typical commercial additive package for use in conventional automotive automatic transmission fluids of the "Ford" type. The package comprises additives for EP, antioxidant, antirust, dispersant, anticopper corrosion and antifoam.
**Hydrogenated paraffinic oil
***PAMVCH = a hydrogenated dimerizate of -methylstyrene, mainly the hydrindan form.
N.B. All percentages in the above table are by volume

TABLE IV

POLAR TRACTANTS

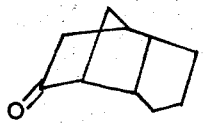

(a)

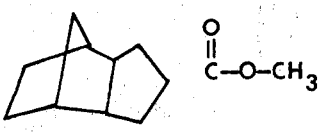

(b)

-continued

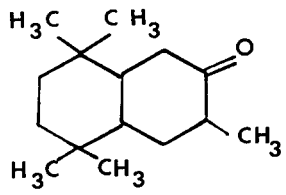

(c)

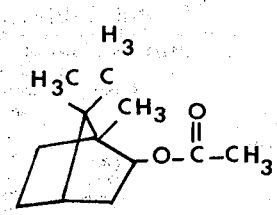

(d)

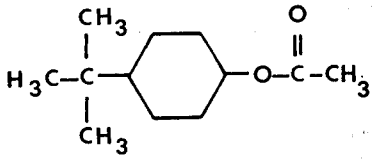

(e)

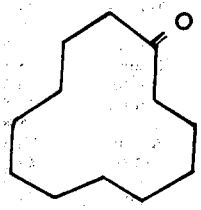

(f)

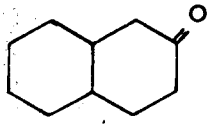

(g)

The invention claimed is:

1. In a friction or tractive drive comprising at least two relatively rotatable members in torque transmitting relationship, the improvement wherein the tractive surfaces of said members have disposed thereon a fluid tractant composition comprising from 1.0 to 100 weight percent of a polar compound having the structural formula:

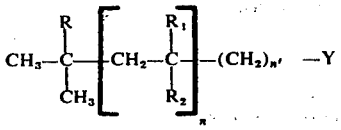

wherein $n$ is an integer from 1 to 30, $n'$ is an integer 0 or 1 and R, $R_1$ and $R_2$ are at least one member independently selected from methyl, ethyl, propyl, isopropyl, butyl, isobutyl, tertbutyl, isopentyl, neopentyl, cyclohexyl, methylcyclohexyl, indanyl, hydrindanyl, cyclohexylindanyl and cyclohexylhydrindanyl and where Y is a functional group which makes said polar compound an acyl hydrazide, oxime, amide or imine.

2. A drive according to claim 1 wherein said polar compound has the structural formula:

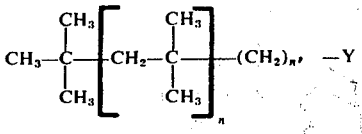

wherein $n$, $n'$ and Y are as defined in claim 1.

3. The drive as defined in claim 2 and wherein $n$ is an integer of from 3 to 20.

4. A drive according to claim 2 and containing an oil of lubricating viscosity comprising at least one member from the group consisting of synthetic esters, paraffinic oils, naphthenic oils, olefin homopolymer oils, olefin copolymer oils and said oils which have been at least partially hydrogenated.

5. A drive according to claim 2 and containing a hydrocarbon base stock of lubricating viscosity and from 1.0 to 75 weight percent of said polar compound.

6. A drive according to claim 1 and wherein at least one of said polar compounds has the formula:

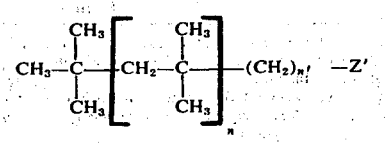

wherein Z' is selected from:

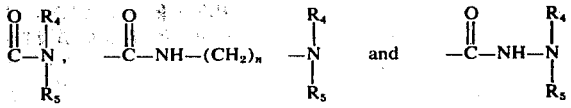

(a) (b) (c)

wherein $n''$ is 0 or 1, n is an integer of 0 to 17 inclusive, $R_3$ is $C_1$–$C_7$ alkyl, or saturated, olefinic unsaturated or aromatic cyclic or alkyl-substituted cyclic hydrocarbons; and $R_4$ and $R_5$ are hydrogen or $R_3$; and wherein each of $R_4$ and $R_5$, when on the same molecule, may be the same or different.

7. A drive according to claim 6 and containing a hydrocarbon base stock comprising from 10 to 90 volume percent of at least one member from the group consisting of paraffinic oils, naphthenic oils, olefin homopolymer oils, olefin copolymer oils, and said oils which have been at least partially hydrogenated.

8. A drive according to claim 1 wherein said composition comprises a hydrocarbon base stock of lubricating viscosity and from 1.0 to 75 weight percent of said polar compound.

9. The drive as defined in claim 6 and wherein when Z′ is (a), *n* is an integer from 1 to 15 inclusive, and when Z′ is (b), *n* is an integer from 2 to 16 and when Z′ is (c), *n* is an integer from 3 to 17.

10. A drive according to claim 1 and containing a hydrocarbon base stock comprising from 10 to 90 volume percent of at least one member from the group consisting of paraffinic oils, naphthenic oils, olefin homopolymer oils, olefin copolymer oils, and said oils which have been at least partially hydrogenated.

11. A drive according to claim 1 wherein said composition comprises a hydrocarbon base stock of lubricating viscosity and from 1.0 to 75 weight percent of said polar compound.

12. A method of improving the coefficient of traction between two relatively rotating members in torque transmitting relationship, said method comprising introducing between said members a lubricant composition comprising from 1.0 to 100 weight percent of a polar compound in an amount effective to improve said coefficient, said polar compound having the structural formula:

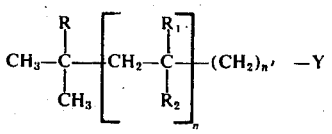

wherein *n* is an integer from 1 to 30, *n′* is an integer 0 or 1 and R, $R_1$ and $R_2$ are at least one member independently selected from methyl, ethyl, propyl, isopropyl, butyl, isobutyl, tertbutyl, isopentyl, neopentyl, cyclohexyl, methylcyclohexyl, indanyl, hydrindanyl, cyclohexylindanyl and cyclohexylhydrindanyl and where Y is a functional group which makes said polar compound an acyl hydrazide, oxime, amide or imine.

13. A drive according to claim 1 wherein said polar compound is an acyl hydrazide.

14. A drive according to claim 1 wherein said polar compound is an oxime.

15. A drive according to claim 1 wherein said polar compound is an amide.

16. A drive according to claim 1 wherein said polar compound is an imine.

* * * * *